US008031154B2

(12) United States Patent
Mamba et al.

(10) Patent No.: US 8,031,154 B2
(45) Date of Patent: Oct. 4, 2011

(54) DISPLAY DEVICE

(75) Inventors: Norio Mamba, Kawasaki (JP); Tsutomu Furuhashi, Yokohama (JP)

(73) Assignee: Hitachi Displays, Ltd., Chiba (JP)

( * ) Notice: Subject to any disclaimer, the term of this patent is extended or adjusted under 35 U.S.C. 154(b) by 872 days.

(21) Appl. No.: 12/017,357

(22) Filed: Jan. 22, 2008

(65) Prior Publication Data

US 2008/0186267 A1 Aug. 7, 2008

(30) Foreign Application Priority Data

Jan. 22, 2007 (JP) ..... 2007-010952
Jan. 22, 2007 (JP) ..... 2007-011740

(51) Int. Cl.
*G09G 3/36* (2006.01)

(52) U.S. Cl. ..... 345/96; 345/204; 345/94; 345/95; 345/97; 345/690; 345/208; 345/209; 345/210

(58) Field of Classification Search ..... 345/94–97, 345/204, 208–210, 690
See application file for complete search history.

(56) References Cited

U.S. PATENT DOCUMENTS

| | | | | |
|---|---|---|---|---|
| 6,781,605 | B2 | 8/2004 | Kudo et al. | |
| 7,123,247 | B2 | 10/2006 | Morita | |
| 7,319,453 | B2 | 1/2008 | Nojiri et al. | |
| 2002/0158857 | A1 * | 10/2002 | Iisaka | 345/204 |
| 2003/0169247 | A1 * | 9/2003 | Kawabe et al. | 345/204 |
| 2004/0183792 | A1 * | 9/2004 | Takada et al. | 345/204 |
| 2005/0179633 | A1 | 8/2005 | Inada | |
| 2005/0179677 | A1 | 8/2005 | Nojiri et al. | |

FOREIGN PATENT DOCUMENTS

| | | |
|---|---|---|
| CN | 1399241 | 2/2003 |
| CN | 1658258 | 8/2005 |
| CN | 1674082 | 9/2005 |
| JP | 2002-366115 | 12/2002 |
| JP | 2003-058117 | 2/2003 |
| JP | 2005-234029 | 9/2005 |
| JP | 2006-003923 | 1/2006 |

* cited by examiner

*Primary Examiner* — Richard Hjerpe
*Assistant Examiner* — Jeffrey Steinberg
(74) *Attorney, Agent, or Firm* — Antonelli, Terry, Stout & Kraus, LLP.

(57) ABSTRACT

A display panel is scanned every two lines during a period of binary writing area in the first half of one frame period in partial display (or in small gradation display) and a steady-state current of an output amplifier for buffering gradation signals supplied to the display panel in a non-scanning period in the second half of one frame period is reduced.

11 Claims, 24 Drawing Sheets

FIG. 25
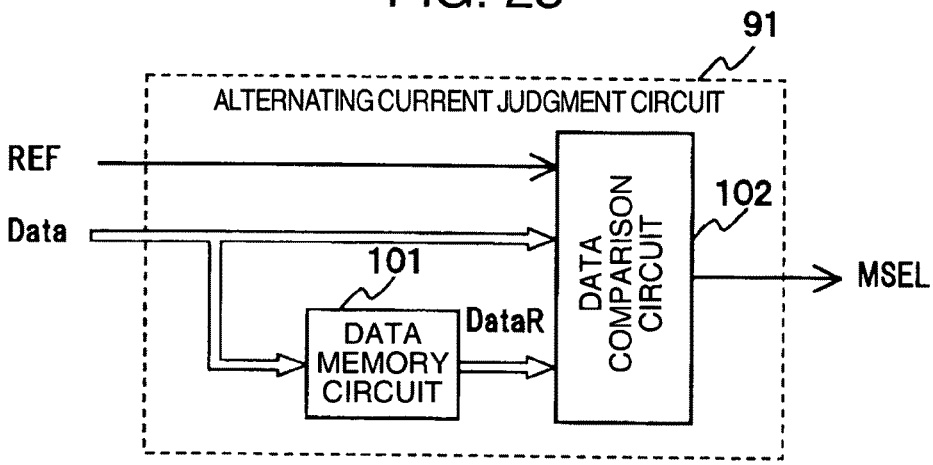
FIG. 26
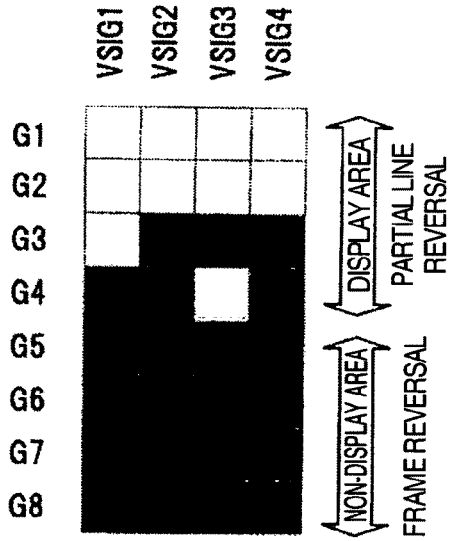
FIG. 27
| Sum | MSEL |
|---|---|
| 0 | 0 |
| 1 | 0 |
| 2 | 1 |
| 3 | 1 |
| 4 | 1 |

DISPLAY DEVICE

CLAIM OF PRIORITY

The present application claims priority from Japanese applications serial no. 2007-010952 filed on Jan. 22, 2007, and serial no. 2007-011740 filed on Jan. 22, 2007, the contents of which are hereby incorporated by reference into this application.

BACKGROUND OF THE INVENTION

The present invention relates to a display device having a multiple gradation display mode and a small gradation display mode (the number of gradations is smaller than that of the multiple gradation display mode) and a driving method thereof and more particularly to a display device such as a liquid crystal display, an organic electroluminescence (EL) display, a plasma display and a field-emission display and a driving method thereof. Furthermore, the present invention relates to a display device having reduced power consumption in partial display.

U.S. Patent Application Serial No. 2005/0179677 (JP-A-2005-234029) discloses an image display device including a scanning circuit composed of a shift register for transferring data in synchronism with a horizontal synchronizing signal Hsync and an AND circuit for producing an output signal on the basis of an enable signal and an output signal of the shift register in order to select a non-display area in the partial display by a plurality of lines to write a signal. A high-level (Hi) period of a start signal supplied to the shift register is set to a plurality of horizontal periods, for example, 4 horizontal periods and the enable signal is made to be high level during only one horizontal period in the plurality of horizontal periods, for example, 4 horizontal periods, so that the scanning circuit capable of selecting a plurality of lines (4 horizontal lines) simultaneously can be realized.

U.S. Pat. No. 6,781,605 (JP-A-2002-366115) discloses a display device in which a current flowing through a circuit part (ladder resistors) for producing gradation voltages unnecessary for display among circuits for producing a plurality of gradation voltages is reduced when the number of gradations to be displayed is reduced.

Further, in display devices for cellular phones, the power consumption in the partial display is not reduced and it is difficult to realize the partial display mode.

U.S. Pat. No. 7,123,247 (JP-A-2006-3923) discloses a display device in which a partial display area is scanned to be driven every frame period and other display area except the partial display area is scanned to be driven every odd frame period to thereby reduce the power consumption.

SUMMARY OF THE INVENTION

In U.S. Patent Application Serial No. 2005/0179677 (JP-A-2005-234029), even when the plurality of lines are selected simultaneously to make writing, operation of the shift register (clock signal and the like) is the same as in the usual display and accordingly it is difficult to reduce the power consumption in the shift register part when the partial display is made. In U.S. Patent Application Serial No. 2005/0179677 (JP-A-2005-234029), even when black data is written in the non-display area, it is necessary to write voltage at a rate of one horizontal period to a plurality of horizontal periods and therefore it is difficult to stop an output amplifier for a long time and reduce steady-state power.

Even in U.S. Pat. No. 6,781,605 (JP-A-2002-366115), since current flowing through a circuit part for producing the gradation voltages unnecessary for display is merely reduced, it is not sufficient to reduce the power consumption.

It is an object of the present invention to provide a display device having reduced power consumption and a driving method thereof. Particularly, the power consumption of a driving circuit is reduced while suppressing deterioration in the picture quality in partial display and small gradation display.

In a first display mode (for example, in non-partial display or multiple gradation display), a display panel is scanned every n (n is an integer larger than or equal to 1) lines during the whole period of one frame period and in a second display mode (for example, in partial display or small gradation display) the display panel is scanned every m (m is an integer larger than n) lines during partial period (for example, in the first half) in one frame period. A current flowing through a driving circuit (for example, buffering amplifier) for driving the display panel is reduced during other period (for example, in the second half) in one frame period.

For example, a scanning circuit includes a shift register which shifts an input signal having a high level during two horizontal periods by two horizontal periods and AND circuits which time-divide output data (high level during two horizontal periods) of the shift register into two periods, and the scanning circuit selects a horizontal line by two driving clocks for time division inputted to the AND circuits successively to make display. In case of the partial display (eight-color display), a control clock period of the shift register is reduced to a half and the two driving clocks are made to be in phase to thereby perform simultaneous selection of two lines. Since dominant capacitance in writing of signals is capacitance of drain lines, the writing time can be made equal to that of usual operation even in the two-line simultaneous selection and the writing time for one picture screen can be shortened to a half of that of the usual operation. A steady-state current of amplifiers for driving the drain lines can be made small during the period in which scanning is not made. Further, the shift register of the scanning circuit is also stopped during this period.

According to the present invention, since the current flowing through the driving circuit for driving the display panel is reduced during other period in one frame period, the power consumption of the driving circuit can be reduced. That is, the steady-state current of amplifiers of a signal output part can be reduced during the period in which scanning is not made in one frame period and accordingly the power consumption can be reduced.

According to the present invention, since the period in which the shift register is stopped can be provided, the power supply and its associated part for driving the shift register can be stopped during the stop period to thereby reduce the power consumption. Since the writing time can be ensured sufficiently, deterioration in the picture quality in partial display can be suppressed. Further, since the scanning circuit does not require any special signal when the partial display is made, increase of the circuit scale can be suppressed.

Furthermore, when the display pattern such as checkered pattern and horizontal striped pattern is displayed in partial display area in case where the partial display is made by frame reversal as in U.S. Pat. No. 7,123,247 (JP-A-2006-3923), the frequency component of the display pattern is high and accordingly electric power for driving signal lines is increased.

Accordingly, it is an object of the present invention to provide a display device having reduced power consumption without deteriorating the picture quality in partial display.

Frame reversal and line reversal are switched in accordance with the display pattern in the partial display area and frame reversal is made in the non-display area except the partial display area.

When the partial display is made, an alternating signal for making frame reversal or line reversal is produced on the basis of an external control signal indicating the partial display. The common voltages are reversed every line or every frame by the alternating signal. Further, display data for two lines are compared to produce the alternating signal.

As described above, according to the present invention, since the common voltages are reversed every line or every frame to display the display pattern, charge and discharge power of the signal voltages to the signal lines can be reduced, so that reduction of electric power can be expected. Moreover, since the non-display part is fixed in the frame reversal, the low electric power can be maintained. In addition, even when the display data for two lines are compared, an amount of data to be compared is small due to the partial display (8 colors) and accordingly the display device can be realized with small circuit scale.

Other objects, features and advantages of the invention will become apparent from the following description of the embodiments of the invention taken in conjunction with the accompanying drawings.

BRIEF DESCRIPTION OF THE DRAWINGS

FIG. 25 is a block diagram illustrating an alternating current judgment circuit 91 used in the circuit shown in FIG. 24;

FIG. 26 is a diagram showing a display picture displayed in a display part;

FIG. 27 is a table showing a judgment signal MSEL;

DESCRIPTION OF THE EMBODIMENTS

In an embodiment 1, there is described an example in which scanning is made every two lines in the first half of one frame period to write gradation signals (e.g. gradation voltages) corresponding to display data in the whole picture screen and any line is not scanned in the second half of one frame period in the partial display/small gradation display mode.

In an embodiment 2, there is described an example in which scanning is made every two lines in two thirds of the first half of one frame period to write gradation signals corresponding to display data in the upper half area and scanning is made every four lines in the remaining one third of the first half of one frame period to write low gradation signals different from display data, any line being not scanned in the second half of one frame period in the partial display/small gradation display mode.

Embodiment 1

Figure 1:
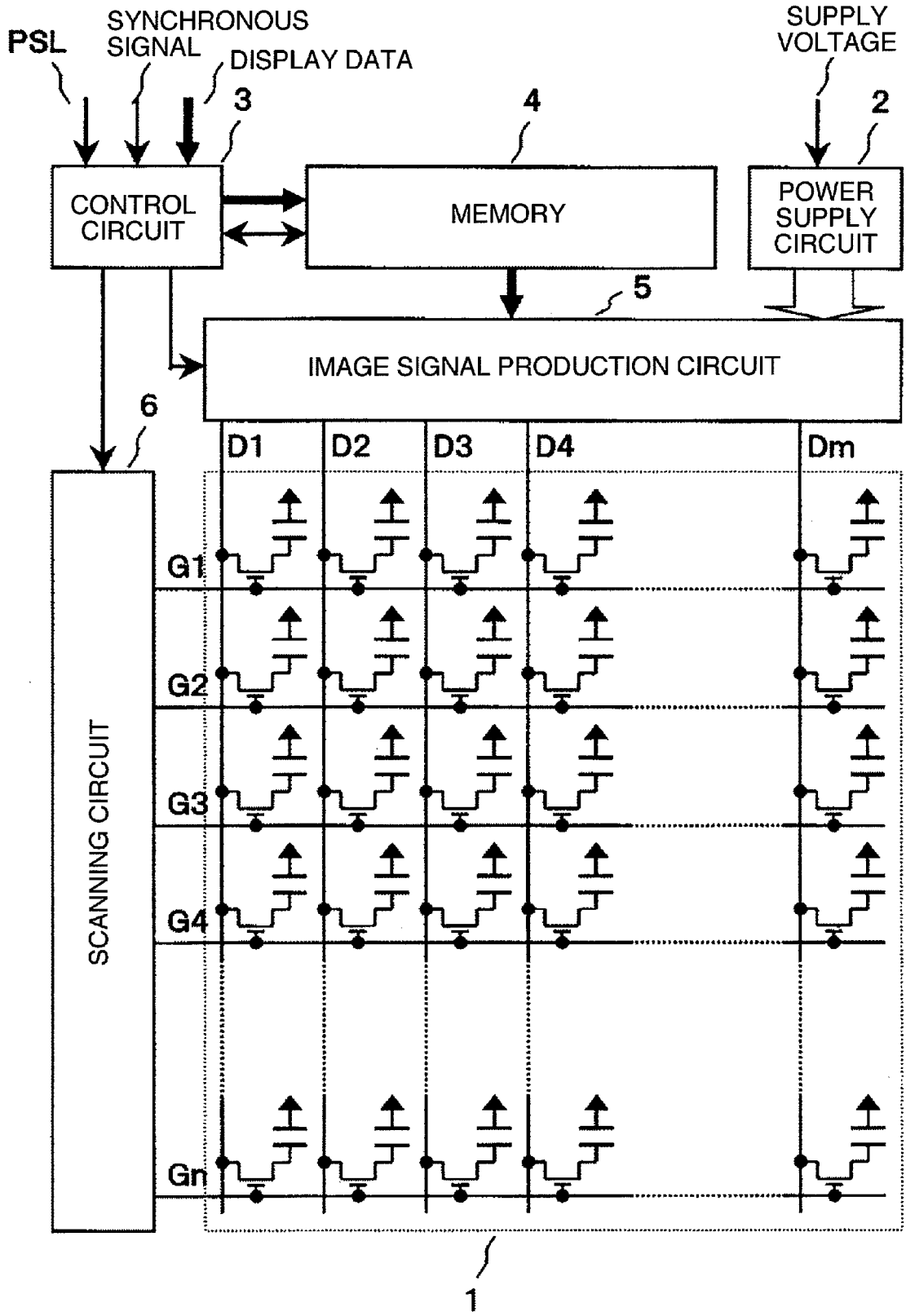
FIG. 1 is a schematic diagram illustrating a display device according to an embodiment 1 of the present invention.

FIG. 1 is a schematic diagram illustrating a display device according to an embodiment 1 of the present invention. In FIG. 1, numeral 1 denotes a display panel including a plurality of pixels arranged in a matrix, 2 a power supply circuit which produces gradation voltages necessary for display from a supply voltage, 3 a control circuit which is supplied with control signals such as PSL signal and synchronous signal, set values and display data supplied from an external apparatus (e.g. microprocessor unit (MPU) of cellular phone) to produce control signals, 4 a memory which temporarily stores display data, 5 an image signal production circuit which applies gradation voltages corresponding to display data to drain lines D1 to Dm and 6 a scanning circuit which scans gate lines G1 to Gn every line or every plural lines.

The display panel 1 includes a plurality of drain lines (signal lines) D1 to Dm, a plurality of gate lines (scanning lines) G1 to Gn and pixels connected to the drain lines and the gate lines. Each pixel includes a thin-film transistor (TFT) and a capacitor element. The power supply circuit 2, the control circuit 3, the memory 4, the image signal production circuit 5 and the scanning circuit 6 may be configured by one large scale integrated circuit (LSI) or separate LSIs as a driving circuit. The memory capacity of the memory 4 is preferably larger than that in which display data for one frame (one picture) can be stored. The PSL signal is a signal for controlling to switch partial operation (display operation in partial area) and non-partial operation (display operation in the whole picture screen). For example, the PSL signal is set to be high level in the partial operation and set to be low level in the non-partial operation. In the partial operation, display data may be rewritten in only partial display area and not be rewritten in other display area or display data may be displayed in only partial display area and black data may be displayed in other display area. Accordingly, the memory capacity of the memory 4 may be that in which display data required in the partial operation is stored. Further, in the partial operation, display data has two gradations (one bit) of on or off for each color of three primary colors RGB (red, green and blue) and in the non-partial operation, display data has full gradations (e.g. 6 or 8 bits). In other words, a small gradation display mode (e.g. 8-color mode) is set in the partial display and a multiple gradation display mode is set in the non-partial display. However, the small gradation display mode is not limited to two gradations (one bit) but may be set to four gradations (two bits) or eight gradations (three bits). In a CPU interface, the PSL signal may be replaced by a set value indicating the partial operation or non-partial operation. When the partial display is made, it is desirable that the memory 4 is provided, although when the partial display is not made and the small gradation display is merely made, the memory 4 may not be provided.

The power supply circuit 2 divides the supply voltage to generate gradation voltages corresponding in number to the number of gradations indicated by display data. The control circuit 3 is supplied with the PSL signal and the synchronous signal from an external apparatus to generate a control signal group. The memory 4 stores display data in accordance with the control signal group and outputs display data in accordance with the control signal group. The image signal production circuit 5 reads out display data from the memory 4 in accordance with the control signal group and converts the display data into gradation voltages to be applied to the drain lines D1 to Dn. On the other hand, the scanning circuit 6 applies selection voltage to the gate lines G1 to Gn successively in accordance with the control signal group and makes the pixels (pixel line) connected to the gate lines G1 to Gn to be a selected state successively. The selected pixels hold electric charges corresponding to the gradation voltages in the capacitor elements and make display with brightness corresponding to the electric charges during one frame.

Figure 2:
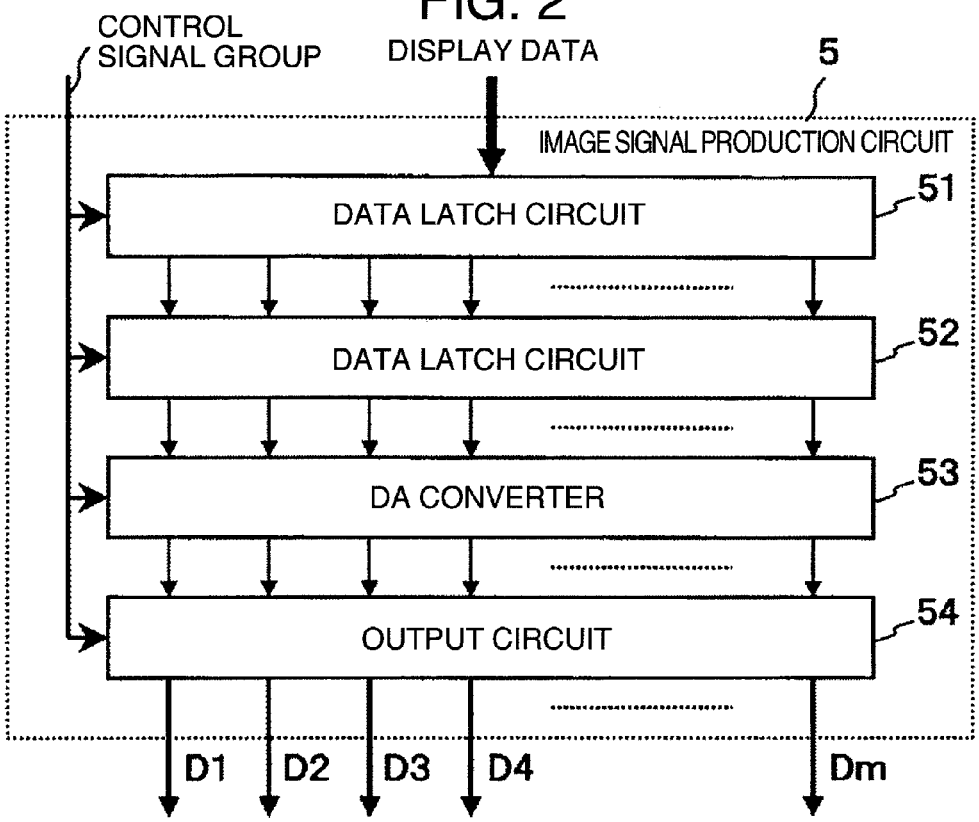
FIG. 2 is an internal block diagram illustrating an image signal production circuit used in the embodiment 1 of the present invention.

FIG. 2 is an internal block diagram illustrating the image signal production circuit used in the embodiment 1 of the present invention. In FIG. 2, numerals 51 and 52 denote data latch circuits which latch display data for one line, 53 a DA (digital-to-analog) converter which converts digital display data into analog gradation voltages, and 54 an output circuit which applies the gradation voltages to the drain lines D1 to Dm.

Figure 6:
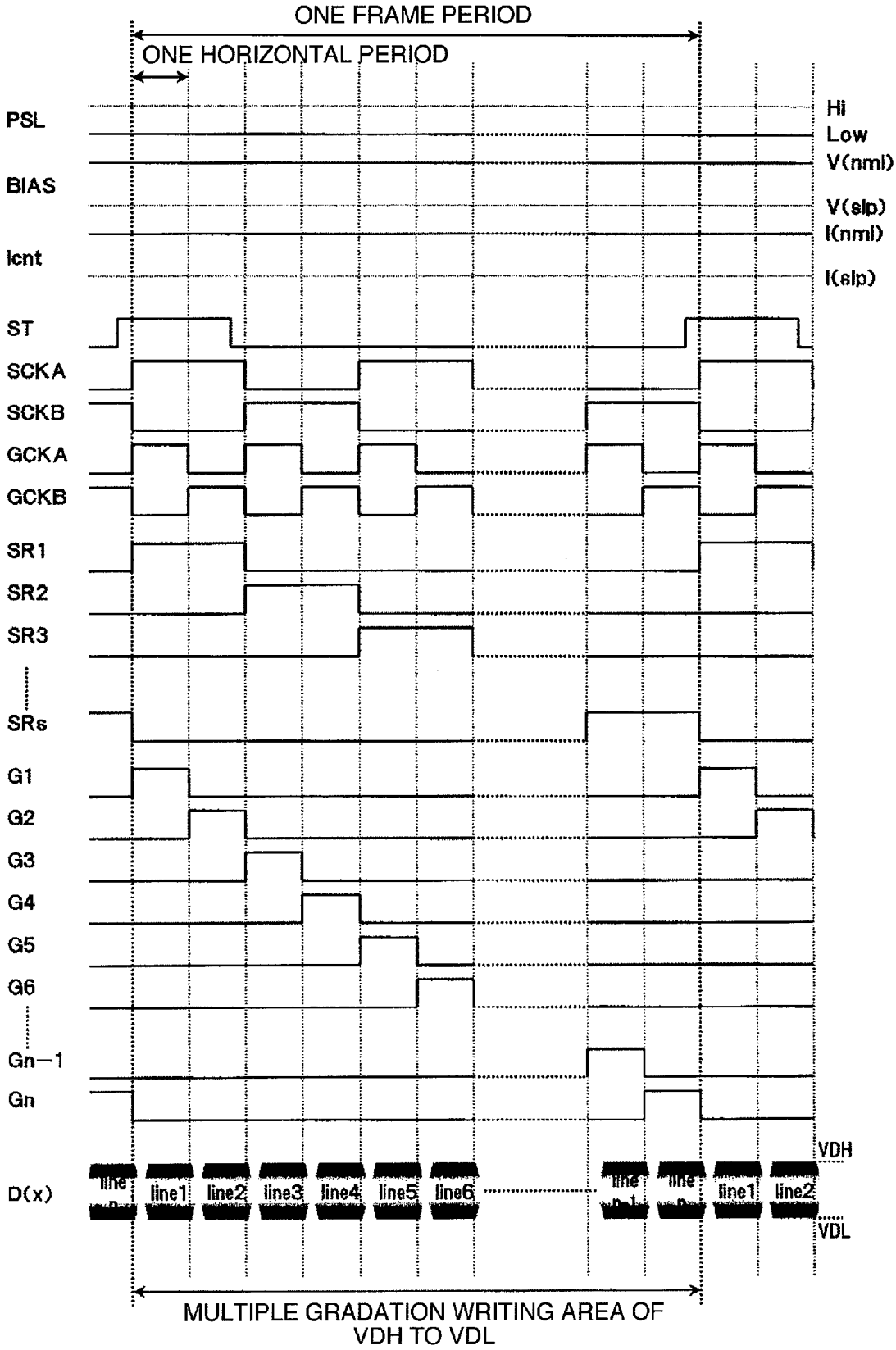
FIG. 6 is a timing chart showing operation in non-partial display in the embodiment 1 of the present invention.
Figure 7:
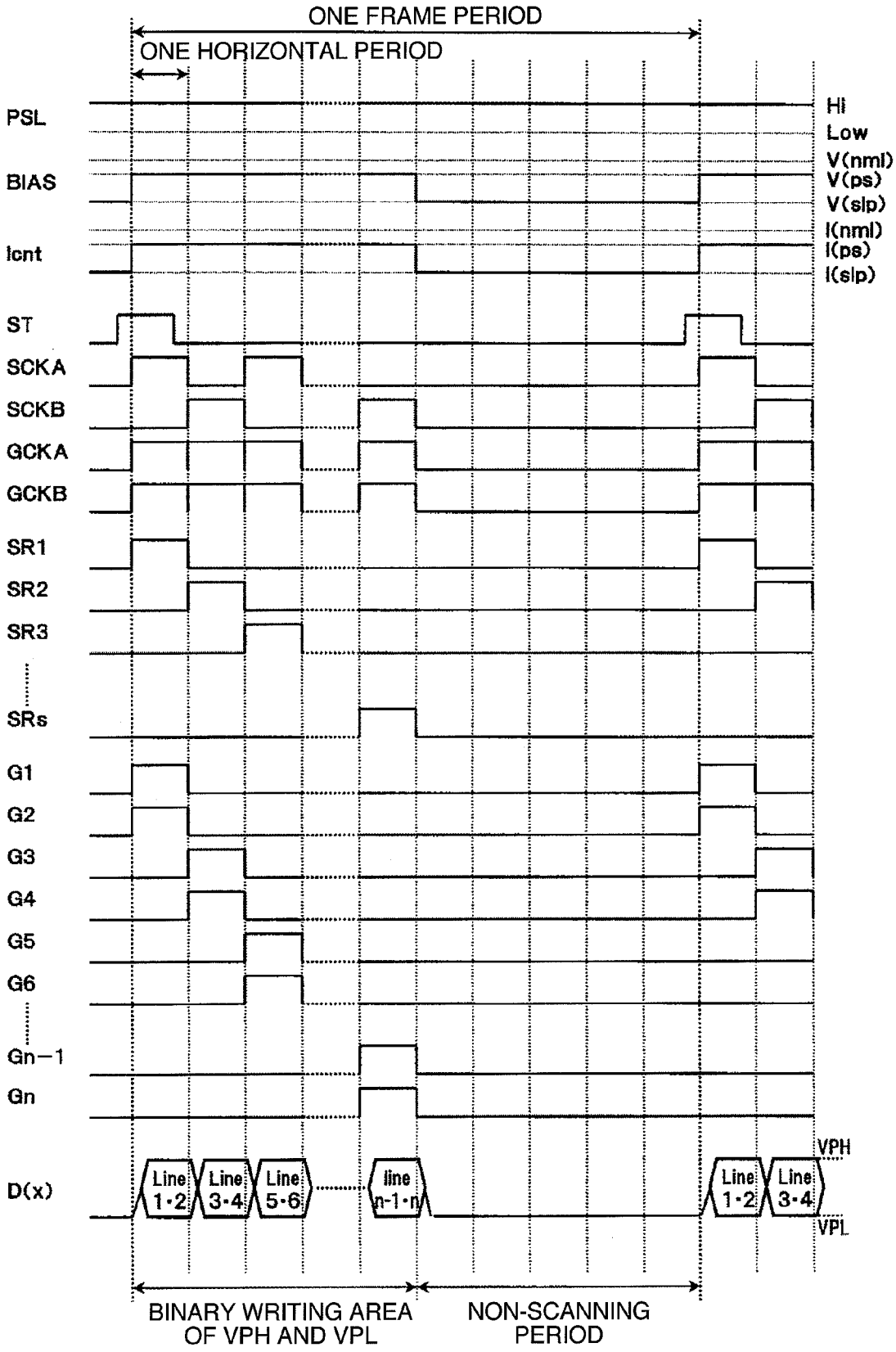
FIG. 7 is a timing chart showing operation in case where the scanning period is reduced in the partial display in the embodiment 1 of the present invention.
Figure 8:
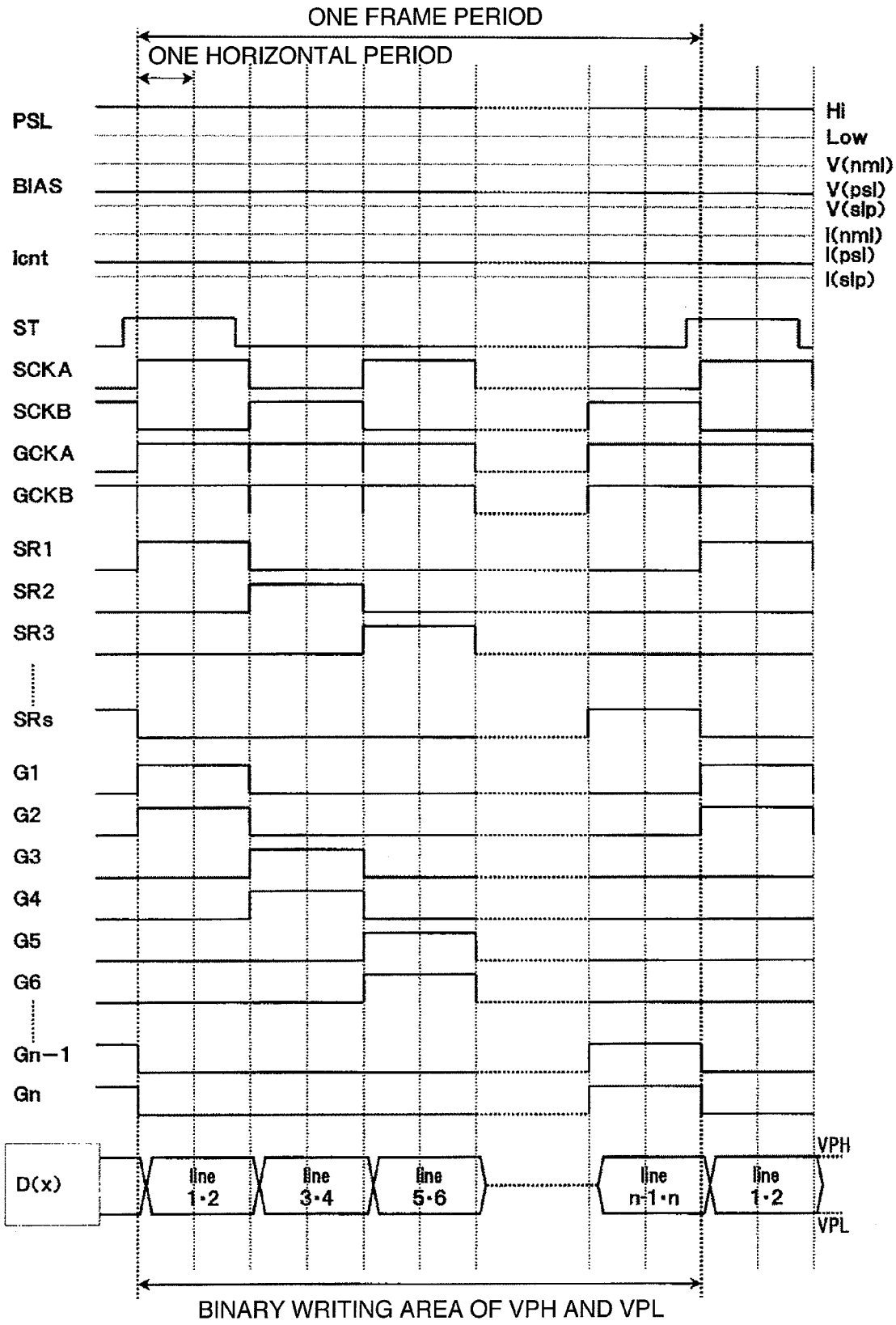
FIG. 8 is a timing chart showing another operation in the partial display in the embodiment 1 of the present invention.

The control signal group includes timing signals and a signal for distinguishing the partial display and the non-partial display in accordance with the PSL signal. The image signal production circuit 5 converts display data as shown in FIG. 6 into a plurality of gradation voltages VDH to VDL to be outputted in case of the non-partial display. On the other hand, the image signal production circuit 5 converts the display data into binary values (VPH, VPL) as shown in FIGS. 7 and 8 in case of the partial display.

The data latch circuit 51 is supplied with display data in accordance with the control signal group successively and outputs the display data for one line. The data latch circuit 52 is supplied with the display data for one line in accordance with the control signal group, holds the display data during one horizontal period and outputs the display data for one line. The DA converter 53 selects gradation voltages corresponding to the display data for one line from the plurality of gradation voltages outputted from the power supply circuit 2 in accordance with the control signal group. The output circuit 54 applies the gradation voltages to the drain lines.

Figure 3:
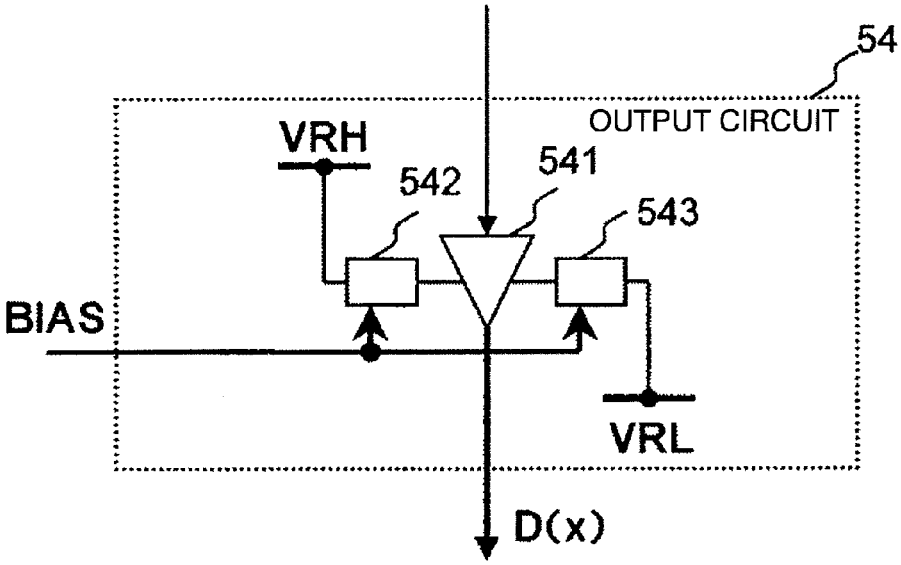
FIG. 3 is a schematic diagram illustrating an internal configuration of an output circuit used in the embodiment 1 of the present invention.

FIG. 3 is a schematic diagram illustrating an internal configuration of the output circuit in the embodiment 1 of the present invention. In FIG. 3, numeral 541 denotes an output amplifier for buffering the gradation voltage, and 542 and 543 denote current control circuits for controlling steady-state current of the output amplifier 541. One output amplifier 541 is provided for one drain line D(x).

A BIAS signal (analog voltage) is contained in the control signal group outputted from the control circuit 3. The current control circuits 542 and 543 are preferably MOS switches. The BIAS signal is inputted to gates of the MOS switches, so that the steady-state current of the output amplifier 541 is controlled in accordance with a voltage value of the BIAS signal.

Figure 4:
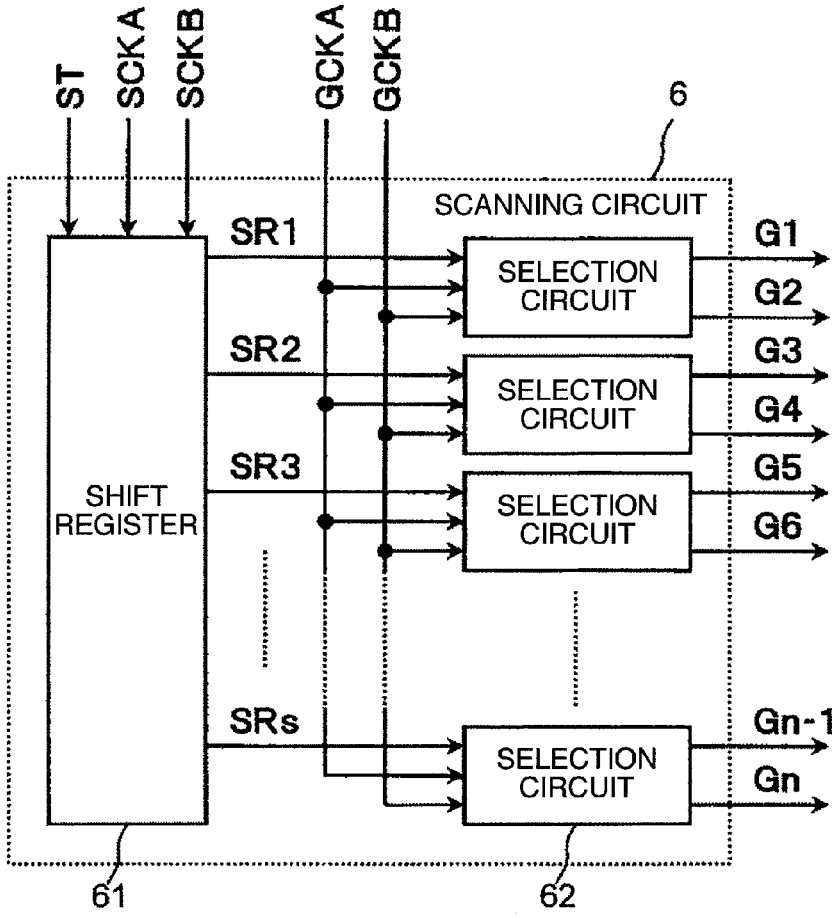
FIG. 4 is a schematic diagram illustrating a scanning circuit used in the embodiment 1 of the present invention.

FIG. 4 is a schematic diagram illustrating the scanning circuit in the embodiment 1 of the present invention. In FIG. 4, numeral 61 denotes a shift register and 62 selection circuits for outputting gate signals to the gate lines in accordance with output signals of the shift register 61 and GCK signals (gate clock signals) contained in the control signal group. One selection circuit 62 is provided for two gate lines.

The shift register 61 is supplied with an ST signal (start signal) and SCK signals (shift clock signal) A and B contained in the control signal group outputted from the control circuit 3 and outputs SR signals (shift register signals) 1 to s (for example, s is equal to n/2). The selection circuit 62 outputs the gate signals to two gate lines in a time-shared manner in accordance with the SR signals 1 to s outputted from the shift register 61 and the GCK signals (gate clock signals) A and B contained in the control signal group.

Figure 5:
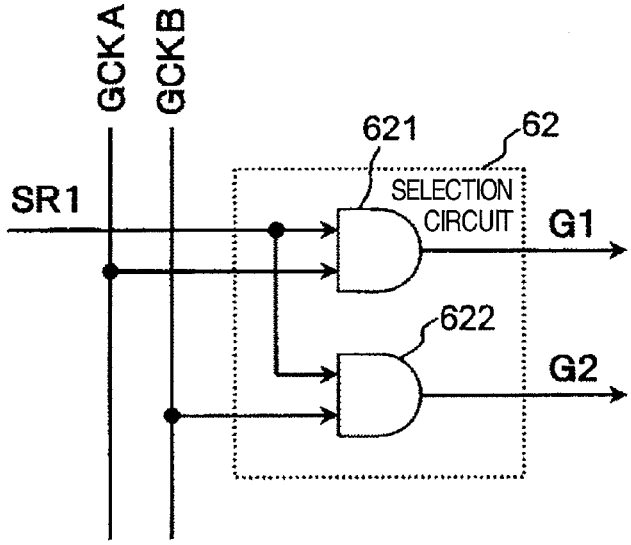
FIG. 5 is a schematic diagram illustrating a selection circuit used in the embodiment 1 of the present invention.

FIG. 5 is a schematic diagram illustrating the selection circuit in the embodiment 1 of the present invention. In FIG. 5, numerals 621 and 622 denote logic circuits. It is desired that level shifters are connected between the output signal (logic amplitude) of the control circuit 3 and outputs (G signals 1 to n) of the selection circuit 62, although the level shifters may be provided in other parts.

The logic circuit 621 is supplied with the SR signal and the GCK signal A and applies the selection voltage to the gate line G1 during the period defined in accordance with values of the SR signal 1 and the GCK signal A. Similarly, the logic circuit 622 is supplied with the SR signal and the GCK signal B and applies the selection voltage to the gate line G2 during the period defined in accordance with values of the SR signal and the GCK signal B. In the embodiment, the logic circuit is AND circuit, for example.

FIG. 6 is a timing chart showing operation in case of the non-partial display in the embodiment 1 of the present invention. In the non-partial display, the PSL signal is set to be low level. In order to set a steady-state current Icnt of the output amplifier 541 to be an optimum current I (nml) at the time of non-partial driving, the BIAS signal is set to a voltage V (nml) for the non-partial display. The BIAS signal is common to the output amplifiers 541 of all the drain lines D1 to Dm.

The ST signal is changed from low level to high level every frame period. The SCK signals are set to be high level and low level repeatedly every two horizontal periods. The SCK signal A is set to be high level during first two horizontal periods in one frame period and the SCK signal B is set to be high level during next two horizontal periods. The GCK signals are set to be high level and low level repeatedly every horizontal period. The GCK signal A is set to be high level during first one horizontal period in one frame period and the GCK signal B is set to be high level during next one horizontal period. The SR signals are set to be high level during two horizontal periods every frame period. The SR signal 1 is set to be high level during first two horizontal periods in one frame period. The SR signal 2 is set to be high level during next two horizontal periods. The SR signal 3 is set to be high level during further next two horizontal periods subsequent thereto. That is, the high level periods of the SR signals 1 to s are shifted every two horizontal periods. The G signals (gate signals) are set to be high level during one horizontal period in one frame period. The G signal 1 is set to be high level during first one horizontal period in one frame period. The G signal 2 is set to be high level during next one horizontal period. The G signal 3 is set to be high level during further next one horizontal period subsequent thereto. That is, the high level periods of the G signals 1 to n are shifted every horizontal period.

The shift register 61 sets the SR signal 1 to be high level during the period (two horizontal periods) that the SCK signal A is high level when the ST signal is high level and then sets the SR signal 2 to be high level during the period (two horizontal periods) that the SCK signal B is high level. Next, the shift register 61 sets the SR signal 3 to be high level during the period (two horizontal periods) that the SCK signal A is high level. The logic circuit 621 of the selection circuit 62 sets the G signal 1 to be high level during the period (one horizontal period) that the GCK signal A is high level when the SR signal 1 is high level. The logic circuit 622 of the selection circuit 62 sets the G signal 2 to be high level during the period (one horizontal period) that the GCK signal B is high level when the SR signal 1 is high level. On the other hand, the image signal production circuit 5 applies gradation voltages D(x) corresponding to display data to the drain lines D1 to Dm every horizontal period. That is, in the non-partial display, the pixels of the display panel are scanned every line and are supplied with the gradation voltages corresponding to the display data.

FIG. 7 is a timing chart showing operation in case where the scanning period is shortened in the partial display in the embodiment 1 of the present invention. In the partial display, the PSL signal is set to be high level. In the partial display, the whole pixel lines are successively scanned in the first half of one frame period (active period) and any pixel line is not scanned in the second half of one frame period (sleep period). Further, in the partial display, the BIAS signal is set to V(ps) and the steady-state current Icnt of the output amplifier 541 is set to I(ps) in the first half of one frame period, while the BIAS signal is set to V(slp) and the steady-state current Icnt of the output amplifier 541 is set to I(slp) in the second half of one frame period. Setting of V(nml)>V(ps)>V(slp) makes I(nml)>I(ps)>I(slp). Accordingly, (electric power of the output amplifier 541 in the non-partial display)>(electric power of the output amplifier 541 during the active period in the partial display)>(electric power of the output amplifier 541 during the sleep period in the partial display). I(slp) is a current in case where the output amplifier 541 is made to be in a stop or sleep state. Therefore, the power consumption of the output amplifier can be reduced in the partial display.

The ST signal is changed from low level to high level every frame period. The SCK signals are set to be high level and low level repeatedly every horizontal period in the first half of one frame period and are set to be low level in the second half of one frame period. The SCK signal A is set to be high level during first one horizontal period in one frame period and the SCK signal B is set to be high level during next one horizontal period. The SCK signals A and B are both set to be low level in the second half of one frame period. The GCK signals A and B are both set to be high level in the first half of one frame period and to be low level in the second half of one frame period. The SR signals are set to be high level during one horizontal period in the first half of one frame period and to be low level in the second half of one frame period. The SR signal 1 is set to be high level during first one horizontal period in one frame period. The SR signal 2 is set to be high level during next one horizontal period. The SR signal 3 is set to be high level during further next one horizontal period subsequent thereto. That is, the high level periods of the SR signals 1 to s are shifted every one horizontal period. The G signals (gate signals) are set to be high level during one horizontal period in the first half of one frame period and to be low level in the second half of one frame period. The G signals 1 and 2 are both set to be high level during first one horizontal period in one frame period. The G signals 3 and 4 are both set to be high level during next one horizontal period. The G signals 5 and 6 are both set to be high level during further next one horizontal period subsequent thereto. That is, the G signals 1 to n are grouped in two adjacent G signals and the high level periods of the grouped G signals are shifted every horizontal period.

The shift register 61 sets the SR signal 1 to be high level during the period (one horizontal period) that the SCK signal A is high level when the ST signal is high level and then sets the SR signal 2 to be high level during the period (one horizontal period) that the SCK signal B is high level. Next, the shift register 61 sets the SR signal 3 to be high level during the period (one horizontal period) that the SCK signal A is high level. The logic circuit 621 of the selection circuit 62 sets the G signal 1 to be high level during the period (one horizontal period) that the GCK signal A is high level when the SR signal 1 is high level. The logic circuit 622 of the selection circuit 62 sets the G signal 2 to be high level during the period (one horizontal period) that the GCK signal B is high level when the SR signal 1 is high level. On the other hand, the image signal production circuit 5 applies any of two gradation voltages D(x) corresponding to display data to the drain lines D1 to Dm every horizontal period and does not apply any gradation voltage thereto in the second half of one frame period.

In the partial display, the period of the control signals (ST signal, SCK signals A and B) of the shift register is made to ½ and the GCK signals A and B for selection of gate line are made to be in phase with each other to be outputted every horizontal period, so that voltages for the whole horizontal lines can be rewritten in a half period of the non-partial display. Further, the voltages applied to the pixels are only binary value of VPL and VPH for controlling on and off and the picture quality is difficult to deteriorate in the binary control (8-color display in RGB). Accordingly, the steady-state current of the output amplifier can be also optimized to be made smaller than the usual current.

In the partial display, any pixel line may not be scanned in the first half of one frame period (sleep period) and the whole pixel lines may be successively scanned in the second half of one frame period (active period). Further, the active period and the sleep period are not required to be a half of one frame period. If the active period is made longer than the sleep period, the picture quality can be improved and if the sleep period is made longer than the active period, the power consumption can be further reduced.

Although not shown, since it is not necessary to operate the shift register in the second half of one frame period, the power supply for operation of the shift register or the steady-state current of the amplifier for production of the control signal group (ST signal, SCK signal and GCK signal) can be made to be in a sleep state. Consequently, in the partial display, the power consumption of the scanning circuit 6 can be reduced. Further, although not shown, in the partial display, the circuit for producing the gradation voltages unnecessary for display (for example, intermediate gradation voltage except maximum and minimum gradation voltages) may be stopped in the first half of one frame period (active period) and the circuit for producing all the gradation voltages may be stopped in the second half of one frame period (sleep period). Consequently, in the partial display, the power consumption of the power supply circuit 2 can be reduced. Moreover, in the second half of one frame period, the current flowing through the power supply circuit 2, the image signal production circuit 5 and the scanning circuit 6 may be reduced and the power supply circuit 2, the image signal production circuit 5 and the scanning circuit 6 may be made to be in a stop or sleep state.

FIG. 8 is a timing chart showing another operation in the partial display in the embodiment 1 of the present invention. This operation is different from that of FIG. 7 in that the sleep period is not provided and the writing time (scanning time) of each line is made longer (about twice as long as usual operation). Consequently, the steady-state current of the output amplifier is suppressed low and the power consumption is reduced.

The ST signal is changed from low level to high level every frame period. The SCK signals are set to be high level and low level repeatedly every two horizontal periods. The SCK signal A is set to be high level during first two horizontal periods in one frame period and the SCK signal B is set to be high level during next two horizontal periods. The GCK signals A and B are both set to be high level during the whole frame period. The SR signals are set to be high level during two horizontal periods in one frame period. The SR signal 1 is set to be high level during first two horizontal periods in one frame period. The SR signal 2 is set to be high level during next two horizontal periods. The SR signal 3 is set to be high level during further next two horizontal period subsequent thereto. That is, the high level periods of the SR signals 1 to s are shifted every two horizontal periods. The G signals (gate signals) are set to be high level during two horizontal periods in one frame period. The G signals 1 and 2 are set to be high level during first two horizontal periods in one frame period. The G signals 3 and 4 are set to be high level during next two horizontal periods. The G signals 5 and 6 are set to be high level during further next two horizontal periods subsequent thereto. That is, the G signals 1 to n are grouped in two adjacent G signals and the high level periods of the grouped G signals are shifted every two horizontal periods.

The shift register 61 sets the SR signal 1 to be high level during the period (two horizontal periods) that the SCK signal A is high level when the ST signal is high level and then sets the SR signal 2 to be high level during the period (two horizontal periods) that the SCK signal B is high level. Next, the shift register 61 sets the SR signal 3 to be high level during the period (two horizontal periods) that the SCK signal A is high level. The logic circuit 621 of the selection circuit 62 sets the G signal 1 to be high level during the period (two horizontal periods) that the GCK signal A is high level when the SR signal 1 is high level. The logic circuit 622 of the selection circuit 62 sets the G signal 2 to be high level during the period (two horizontal periods) that the GCK signal B is high level when the SR signal 1 is high level. On the other hand, the image signal production circuit 5 applies any of two gradation voltages D(x) corresponding to display data to the drain lines D1 to Dm every two horizontal periods. That is, in the partial display, the pixels of the display panel are scanned every two lines and are supplied with any of two gradation voltages D(x) corresponding to the display data.

Figure 9A:
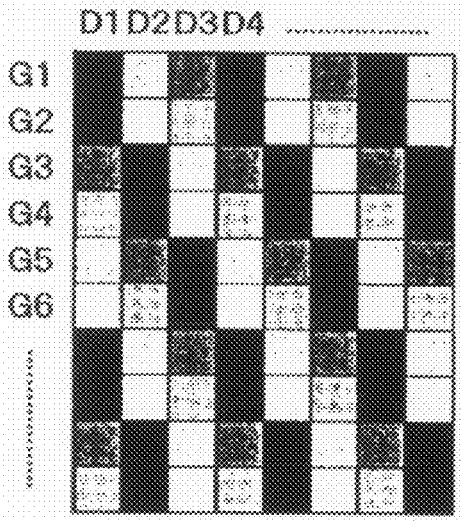
FIGS. 9A and 9B are diagrams showing display pictures in the embodiment 1 of the present invention.
Figure 9B:
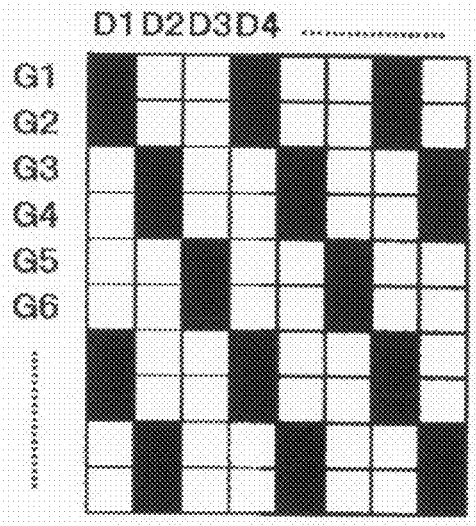

FIG. 9A is a diagram showing a display picture in the non-partial display (corresponding to FIG. 6) in the embodiment 1 of the present invention and FIG. 9B is a diagram showing a display picture in the partial display (corresponding to FIG. 7 or 8) in the embodiment 1 of the present invention.

In the non-partial display, the pixels show brightness corresponding to display data of multiple gradations (e.g. 6 or 8 bit). In the partial display, the pixels arranged every two lines show brightness corresponding to display data of small gradations (e.g. 1 bit). In the partial display, the resolution in the vertical direction is degraded by simultaneous selection of two lines, while there is no problem (particularly when the resolution of panel is high as VGA) when special display such as partial display (information requiring no resolution such as time information and incoming status in cellular phones) is made.

Embodiment 2

FIGS. 1 to 3 are common to the embodiment 1.

Figure 10:
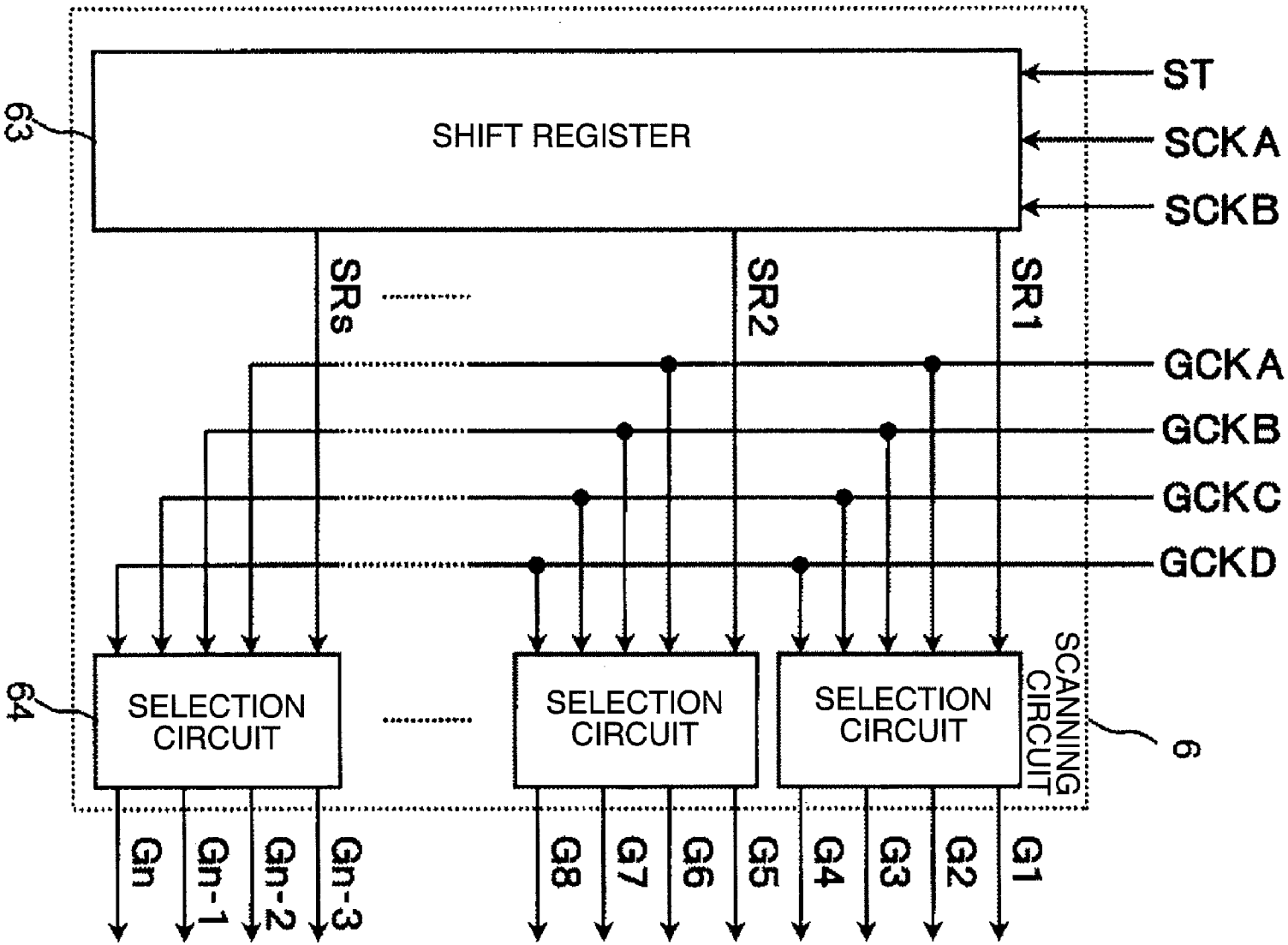
FIG. 10 is a schematic diagram illustrating a scanning circuit used in an embodiment 2 of the present invention.

FIG. 10 is a schematic diagram illustrating a scanning circuit 6 used in an embodiment 2 of the present invention. In FIG. 10, numeral 63 denotes a shift register and 64 selection circuits. One selection circuit 64 is provided every 4 gate lines.

The shift register 63 is supplied with the ST signal, the SCK signals A and B contained in the control signal group outputted by the control circuit 3 and produces the SR signals 1 to s (for example, s is equal to n/4). The selection circuits 64 produce gate signals onto 4 gate lines on the basis of the SR signals 1 to s outputted by the shift register 63 and the GCK signals A, B, C and D contained in the control signal group in a time-shared manner.

Figure 11:
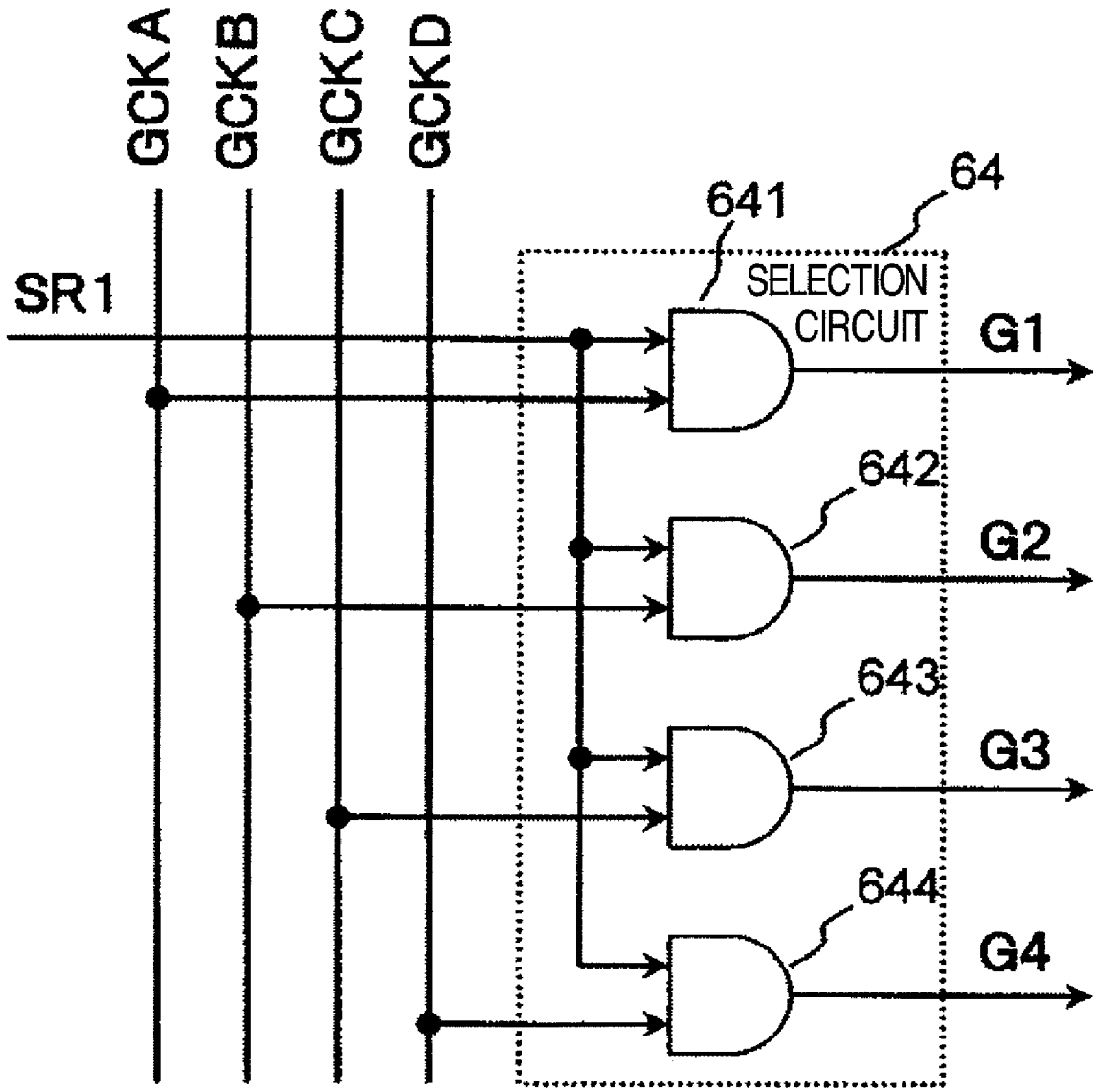
FIG. 11 is a schematic diagram illustrating a selection circuit used in the embodiment 2 of the present invention.

FIG. 11 is a schematic diagram illustrating the selection circuit used in the embodiment 2 of the present invention. In FIG. 11, numerals 641 to 644 denote logic circuits.

The logic circuit 641 is supplied with the SR signal and the GCK signal A and applies the selection voltage to the gate line G1 during the period corresponding to values of the SR signal 1 and the GCK signal A. Similarly, the logic circuit 642 is supplied with the SR signal and the GCK signal B and applies the selection voltage to the gate line G2 during the period corresponding to values of the SR signal and the GCK signal B. Similarly, the logic circuit 643 is supplied with the SR signal and the GCK signal C and applies the selection voltage to the gate line G3 during the period corresponding to values of the SR signal and the GCK signal C. Similarly, the logic circuit 644 is supplied with the SR signal and the GCK signal D and applies the selection voltage to the gate line G4 during the period corresponding to values of the SR signal and the GCK signal D.

Figure 12:
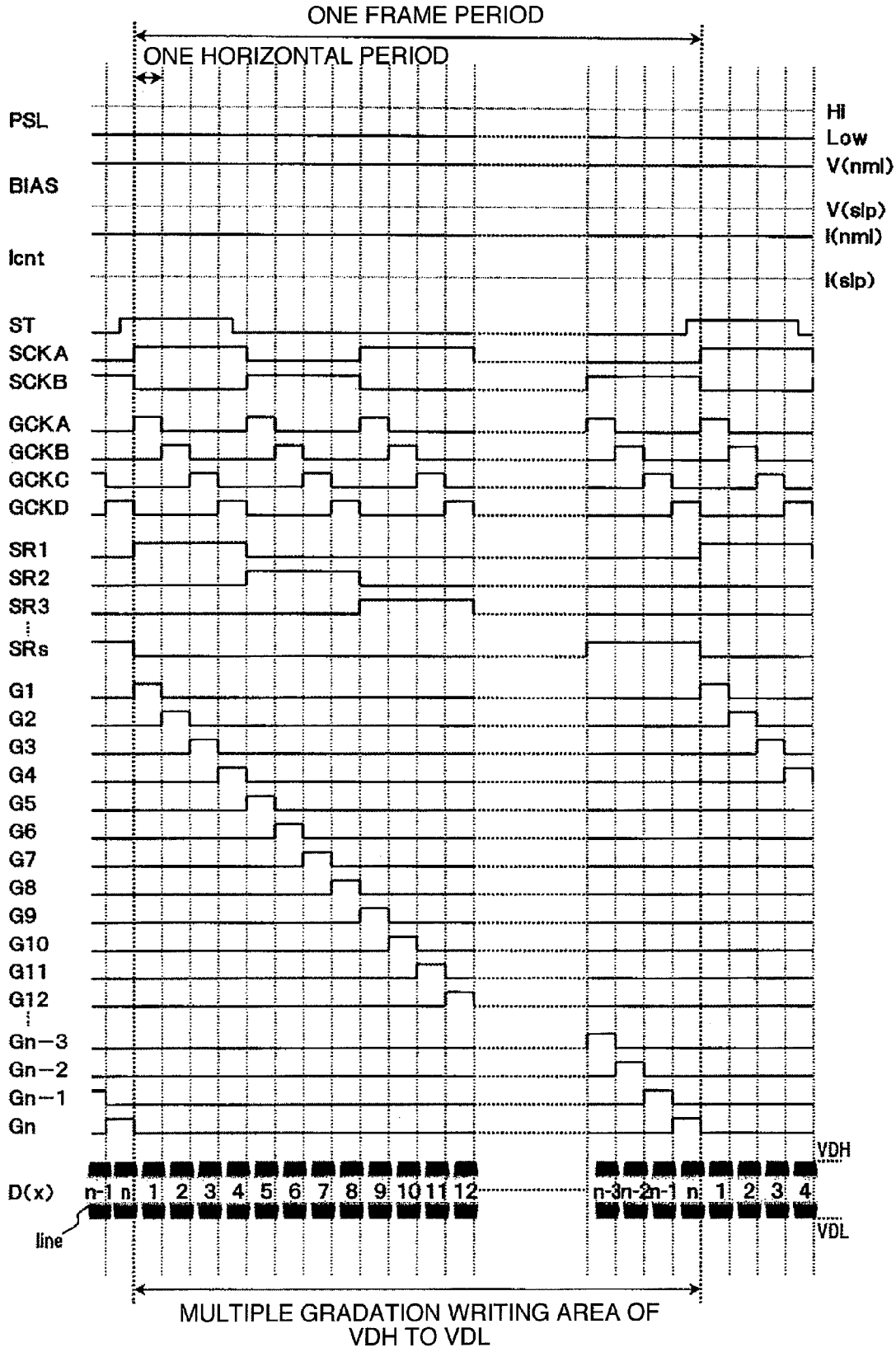
FIG. 12 is a timing chart showing operation in the non-partial display in the embodiment 2 of the present invention.

FIG. 12 is a timing chart showing operation in case of the non-partial display in the embodiment 2 of the present invention. The meanings of PSL, BIAS and Icnt are the same as those of the embodiment 1.

The ST signal is changed from low level to high level every frame period. The SCK signals are set to be high level and low level repeatedly every four horizontal periods. The SCK signal A is set to be high level during first four horizontal periods in one frame period. The SCK signal B is set to be high level during next four horizontal periods. The GCK signals are set to be high level during one horizontal period every four horizontal periods. The GCK signal A is set to be high level during first one horizontal period in one frame period. The GCK signal B is set to be high level during next one horizontal period. The GCK signal C is set to be high level during further next one horizontal period subsequent thereto. The GCK signal D is set to be high level during still further next one horizontal period subsequent thereto. That is, the high level periods of the GCK signals A to D are shifted every one horizontal period. The SR signals are set to be high level during four horizontal periods. The SR signal 1 is set to be high level during first four horizontal periods in one frame period. The SR signal 2 is set to be high level during next four horizontal periods. The SR signal 3 is set to be high level during further next four horizontal periods subsequent thereto. That is, the high level periods of the SR signals 1 to s are shifted every four horizontal periods. The period of the SR signals 1 to is synchronized with the frame period. The G signals (gate signals) are set to be high level during one horizontal period. The G signal 1 is set to be high level during first one horizontal period in one frame period. The G signal 2 is set to be high level during next one horizontal period. The G signal 3 is set to be high level during further next one horizontal period subsequent thereto. That is, the high level periods of the G signals 1 to n are shifted every one horizontal period. The period of the G signals 1 to n is synchronized with the frame period.

The shift register 63 sets the SR signal 1 to be high level during the period (four horizontal periods) that the SCK signal A is high level when the ST signal is high level and then sets the SR signal 2 to be high level during the period (four horizontal periods) that the SCK signal B is high level. Next, the shift register 63 sets the SR signal 3 to be high level during the period (four horizontal periods) that the SCK signal A is high level. The logic circuit 641 of the selection circuit 64 sets the G signal 1 to be high level during the period (one horizontal period) that the GCK signal A is high level when the SR signal 1 is high level. The logic circuit 642 of the selection circuit 64 sets the G signal 2 to be high level during the period (one horizontal period) that the GCK signal B is high level when the SR signal 1 is high level. The logic circuit 643 of the selection circuit 64 sets the G signal 3 to be high level during the period (one horizontal period) that the GCK signal C is high level when the SR signal 1 is high level.

The logic circuit 644 of the selection circuit 64 sets the G signal 4 to be high level during the period (one horizontal period) that the GCK signal D is high level when the SR signal 1 is high level. On the other hand, the image signal production circuit 5 applies the gradation voltages D(x) corresponding to the display data to the drain lines D1 to Dm every horizontal period. That is, in the non-partial display, the pixels of the display panel are scanned every line and are supplied with the gradation voltages corresponding to the display data.

Figure 13:
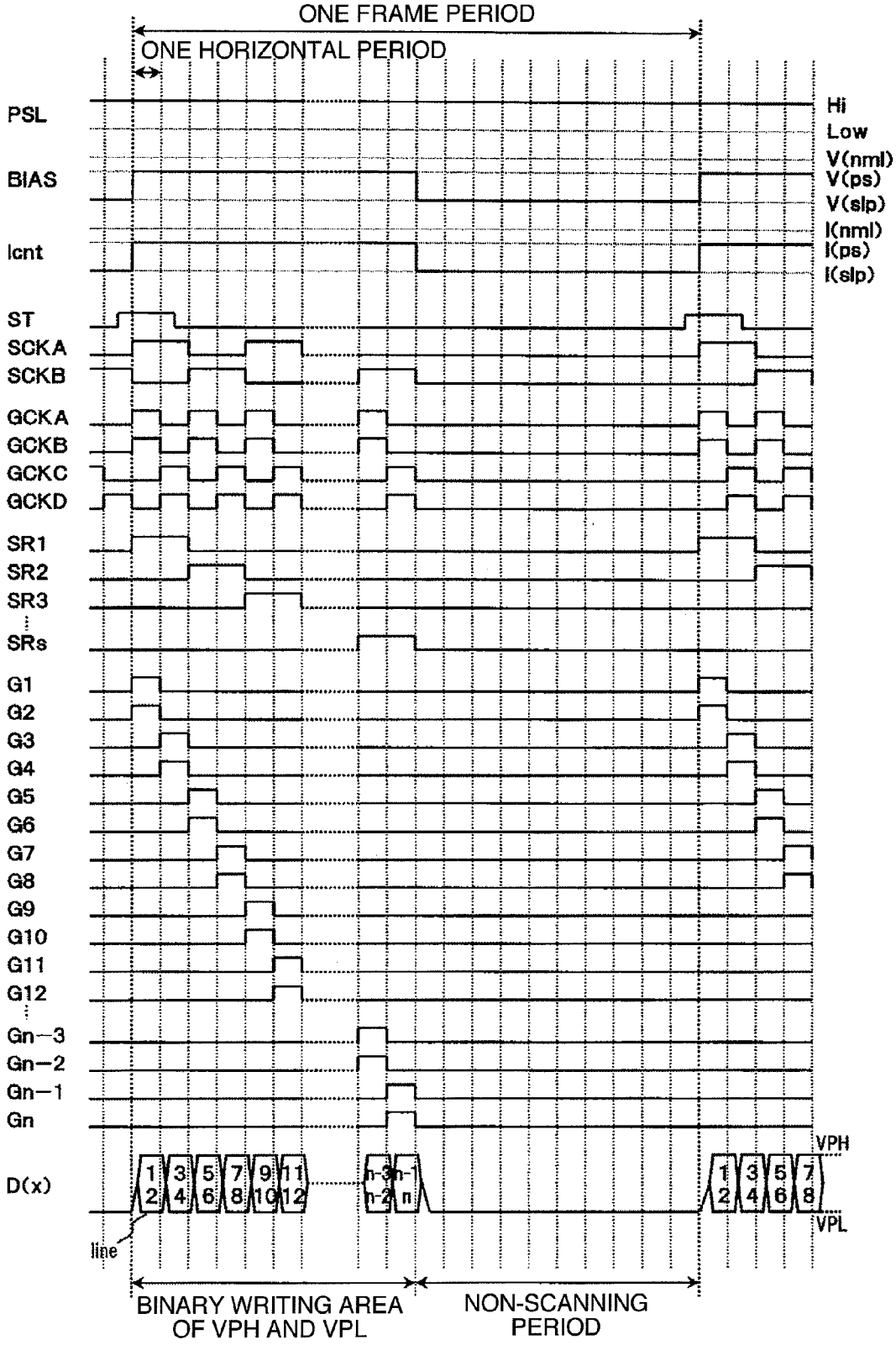
FIG. 13 is a timing chart showing operation in case where the scanning period is reduced in the partial display in the embodiment 2 of the present invention.

FIG. 13 is a timing chart showing operation in case where the scanning period is shortened in the partial display in the embodiment 2 of the present invention. In FIG. 13, the partial display is made in the whole picture screen, that is, the display data is displayed in the whole picture screen. In order to drive two lines simultaneously, the period of the control signals (ST signal, SCK signals A and B and GCK signal) of the shift register 63 is made to ½ and the four GCK signals are set to GCK signal A=GCK signal B and GCK signal C=GCK signal D. With regard to suppression of the current of the output amplifier in the scanning period for the partial display and stop of the current of the output amplifier in the sleep period (non-scanning period), the same effects as in the embodiment 1 are obtained.

The ST signal is changed from low level to high level every frame period. The SCK signals are set to be high level and low level repeatedly every two horizontal periods in the first half of one frame period and are set to be low level in the second half of one frame period. The SCK signal A is set to be high level during first two horizontal periods in one frame period and the SCK signal B is set to be high level during next two horizontal period. The SCK signals A and B are both set to be low level in the second half of one frame period. The GCK signals are set to be high level and low level repeatedly every horizontal period in the first half of one frame period and to be low level in the second half of one frame period. The GCK signals A and B are both set to be high level during first one horizontal period in one frame period. The GCK signals C and D are both set to be high level during next one horizontal period. The SR signals are set to be high level during two horizontal periods in the first half of one frame period and to be low level in the second half of one frame period. The SR signal 1 is set to be high level during first two horizontal periods in one frame period. The SR signal 2 is set to be high level during next two horizontal periods. The SR signal 3 is set to be high level during further next two horizontal periods subsequent thereto. That is, the high level periods of the SR signals 1 to s are shifted every two horizontal periods. The G signals (gate signals) are set to be high level during one horizontal period in the first half of one frame period and to be low level in the second half of one frame period. The G signals 1 and 2 are both set to be high level during first one horizontal period in one frame period. The G signals 3 and 4 are both set to be high level during next one horizontal period. The G signals 5 and 6 are both set to be high level during further next one horizontal period subsequent thereto. That is, the G signals 1 to n are grouped in two adjacent G signals and the high level periods of the grouped G signals are shifted every one horizontal period.

The shift register 63 sets the SR signal 1 to be high level during the period (two horizontal periods) that the SCK signal A is high level when the ST signal is high level and then sets the SR signal 2 to be high level during the period (two horizontal periods) that the SCK signal B is high level. Next, the shift register 63 sets the SR signal 3 to be high level during the period (two horizontal periods) that the SCK signal A is high level. The logic circuit 641 of the selection circuit 64 sets the G signal 1 to be high level during the period (one horizontal period) that the GCK signal A is high level when the SR signal 1 is high level. The logic circuit 642 of the selection signal 64 sets the G signal 2 to be high level during the period (one horizontal period) that the GCK signal B is high level when the SR signal 1 is high level. The logic circuit 643 of the selection circuit 64 sets the G signal 3 to be high level during the period (one horizontal period) that the GCK signal C is high level when the SR signal 1 is high level. The logic circuit 644 of the selection circuit 64 sets the G signal 4 to be high level during the period (one horizontal period) that the GCK signal D is high level when the SR signal 1 is high level. On the other hand, the image signal production circuit 5 applies any of two gradation voltages D(x) corresponding to the display data to the drain lines D1 to Dm every horizontal period and does not apply any gradation voltage thereto in the second half of one frame period.

Figure 14:
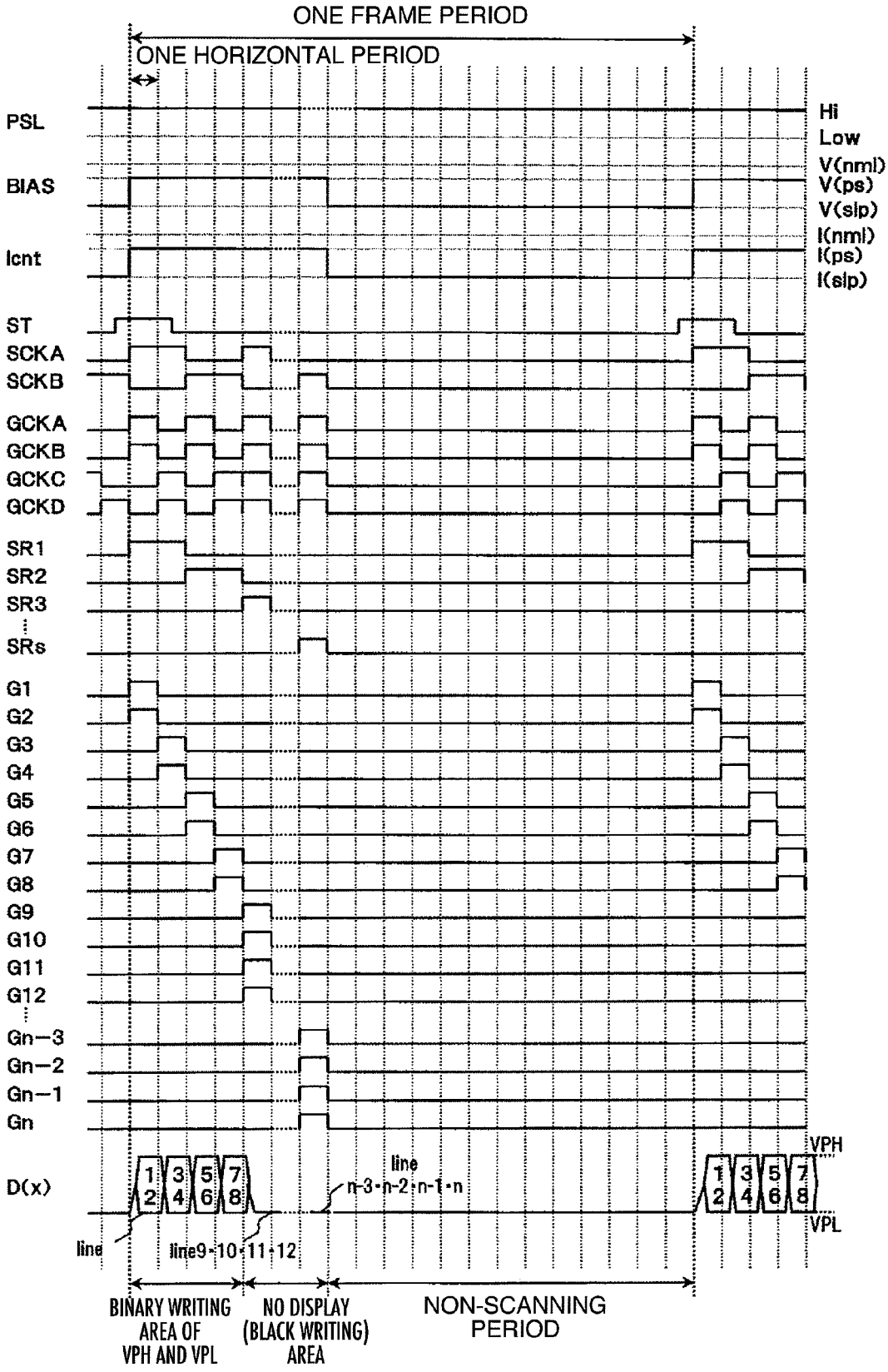
FIG. 14 is a timing chart showing another operation in the partial display in the embodiment 2 of the present invention.

FIG. 14 is a timing chart showing another operation in case of the partial display in the embodiment 2 of the present invention. In FIG. 14, the partial display is made in the upper half area and the non-display (black display) is made in the remaining lower half area. In the non-display (black display) area, reduction in the resolution due to simultaneous selection is out of question. Accordingly, simultaneous selection of four lines can further extend the non-scanning period. Consequently, since the period that the output amplifier can be set to be in a sleep state can be made long, the low power consumption can be realized.

The ST signal is changed from low level to high level every frame period. The SCK signals are set to be high level and low level repeatedly every two horizontal periods in two thirds (binary writing area of display area) of the first half (scanning period of the whole display area) of one frame period and are set to be high level and low level repeatedly every horizontal period in remaining one third (black writing area of non-display area) of the first half of one frame period. The SCK signals are set to be low level in the second half (period except scanning period of the whole display area) of one frame period. The SCK signal A is set to be high level during first two horizontal period in one frame period and the SCK signal B is set to be high level during next two horizontal periods. The SCK signals A and B are both set to be low level in the second half of one frame period. The GCK signals are set to be high level and low level repeatedly every horizontal period in two thirds (binary writing area) of the first half of one frame period and are set to be high level in remaining one third (black writing area) of the first half of one frame period. The GCK signals are set to be low level in the second half of one frame period. The GCK signals A and B are both set to be high level during first one horizontal period in one frame period and to be low level in the second half of one frame period. The GCK signals C and D are both set to be high level during next one horizontal period and to be low level in the second half of one frame period. The SR signals are set to be high level during two horizontal periods in two thirds (binary writing area) of the first half of one frame period every frame period and are set to be high level during one horizontal period in remaining one third (black writing area) of the first half of one frame period. The SR signals are set to be low level in the second half of one frame period. The SR signal 1 is set to be high level during first two horizontal periods in one frame period. The SR signal 2 is set to be high level during next two horizontal periods. The SR signal 3 is set to be high level during further next two horizontal periods subsequent thereto. That is, the high level periods of the SR signals 1 to s are shifted every two horizontal periods in two thirds (binary writing area) of the first half of one frame period and also shifted every one horizontal period in remaining one third (black writing area) of the first half of one frame period. The G signals (gate signals) are set to be high level during one horizontal period in the first half of one frame period and to be low level in the second half of one frame period. The G signals 1 and 2 in the binary writing area are both set to be high level during first one horizontal period in one frame period. The G signals 3 and 4 in the binary writing area are both set to be high level during next one horizontal period. The G signals 5 and 6 in the binary writing area are both set to be high level during further next one horizontal period subsequent thereto. The G signals 9, 10, 11 and 12 in the black writing area are all set to be high level during first one horizontal period in remaining one third of the first half of one frame period. That is, the G signals 1 to n are grouped in two adjacent G signals in two thirds (binary writing area) of the first half of one frame period and the high level periods of the grouped G signals are shifted every one horizontal period. Further, the G signals 1 to n are grouped in four adjacent G signals in remaining one third (black writing area) of the first half of one frame period, the high level periods of the grouped G signals are shifted every one horizontal period.

The shift register 63 sets the SR signal 1 to be high level during the period that the SCK signal A is high level when the ST signal is high level and then sets the SR signal 2 to be high level during the period that the SCK signal B is high level. Next, the shift register 63 sets the SR signal 3 to be high level during the period that the SCK signal A is high level. The logic circuit 641 of the selection circuit 64 sets the G signal 1 to be high level during the period (one horizontal period) that the GCK signal A is high level when the SR signal 1 is high level. The logic circuit 642 of the selection circuit 64 sets the G signal 2 to be high level during the period (one horizontal period) that the GCK signal B is high level when the SR signal 1 is high level. The logic circuit 643 of the selection circuit 64 sets the G signal 3 to be high level during the period (one horizontal period) that the GCK signal C is high level when the SR signal 1 is high level. The logic circuit 644 of the selection circuit 64 sets the G signal 4 to be high level during the period (one horizontal period) that the GCK signal D is high level when the SR signal 1 is high level. On the other hand, the image signal production circuit 5 applies any of two gradation voltages D(x) corresponding to display data to the drain lines D1 to Dm every horizontal period in two thirds (binary writing area) of the first half of one frame period and applies the gradation voltage corresponding to black data thereto every horizontal period in remaining one third (black writing area) of the first half of one frame period. The image signal production circuit 5 does not apply any gradation voltage thereto in the second half of one frame period.

Figures 15A, 15B, 15C:
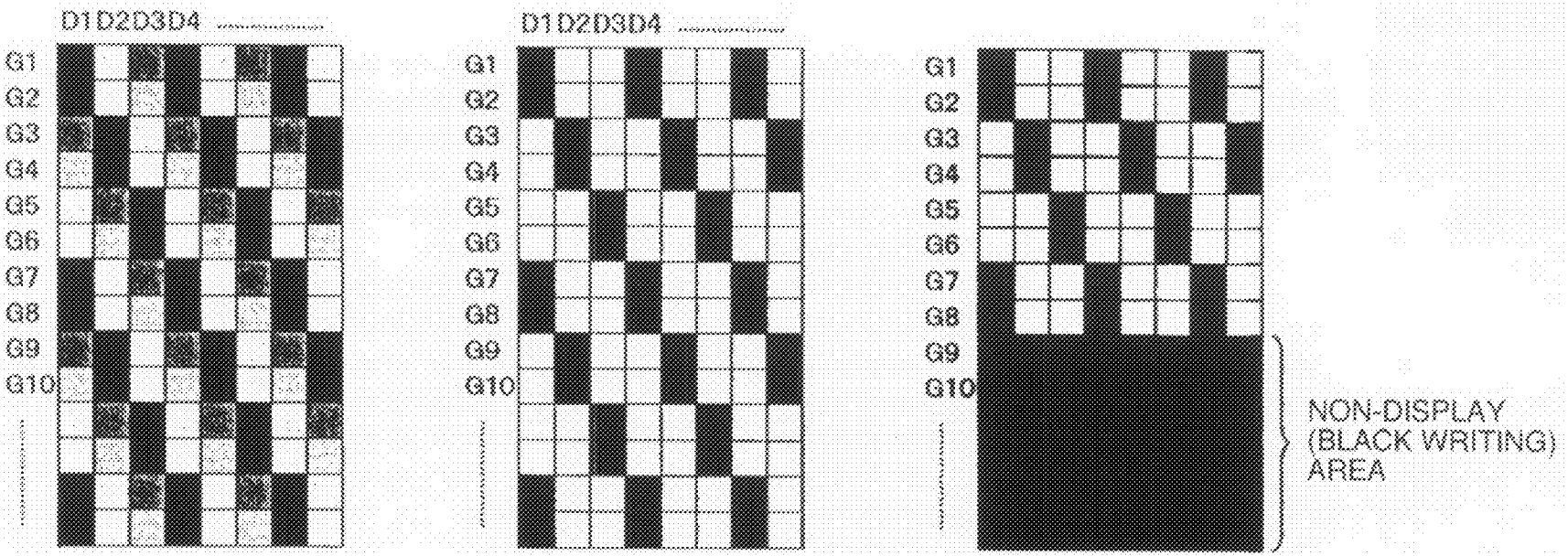
FIGS. 15A to 15C are diagrams showing display pictures in the embodiment 2 of the present invention.

FIG. 15A is a diagram showing a display picture in the non-partial display (corresponding to FIG. 12) in the embodiment 2 of the present invention. FIG. 15B is a diagram showing a display picture in the partial display on the whole picture screen (corresponding to FIG. 13) in the embodiment 2 of the present invention. FIG. 15C is a diagram showing a display picture in the partial display in the upper half area of the whole picture screen (corresponding to FIG. 14) in the embodiment 2 of the present invention.

Reduction in resolution in the partial display area (whole picture screen of FIG. 15B and upper half area of FIG. 15C) is the same as in the embodiment 1.

The present invention can be utilized in liquid crystal displays for cellular phones.

An embodiment of the present invention is now described with reference to the accompanying drawings.

Embodiment 3

Figure 16:
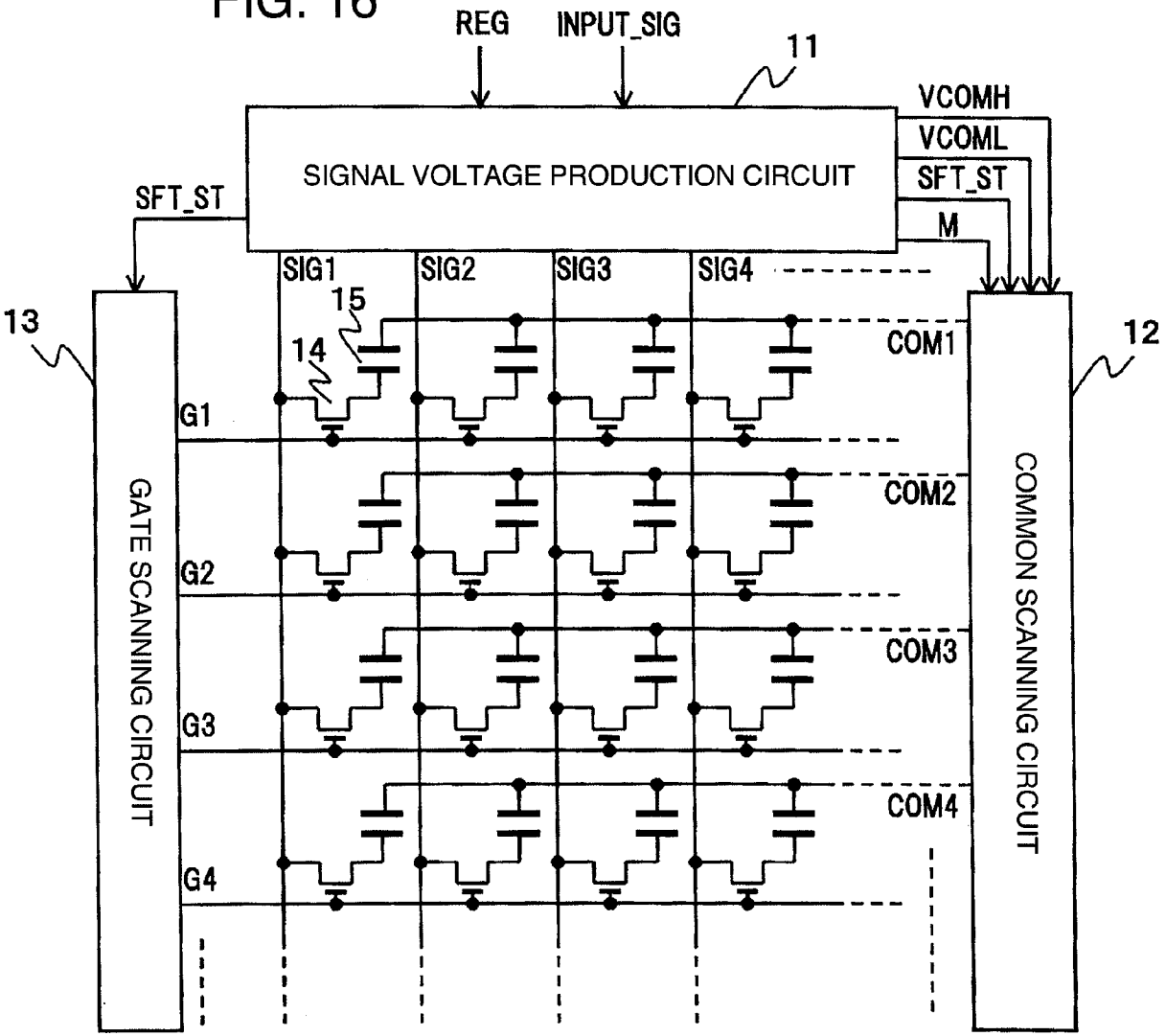
FIG. 16 is a schematic diagram illustrating a display apparatus according to another embodiment of the present invention.

FIG. 16 is a schematic diagram illustrating a display device according to an embodiment 3 of the present invention. In FIG. 16, a signal voltage production circuit 11 is supplied with an input signal INPUT_SIG and a control signal REG externally and produces signal voltages applied to signal lines SIGn (n=1 to N where N is an integer) on the basis of the input signal INPUT_SIG. Further, the signal voltage production circuit 11 produces an alternating signal M supplied to a common scanning circuit 12 on the basis of the inputted control signal REG.

Moreover, the signal voltage production circuit 11 produces scanning signals SFT_ST supplied to the common scanning circuit 12 and a gate scanning circuit 13 on the basis of a synchronous signal contained in the input INPUT_SIG and further produces a high-level common voltage VCOMH and a low-level common voltage VCOML supplied to the common scanning circuit 12.

The common scanning circuit 12 selects any one of the high-level common voltage VCOMH and the low-level common voltage VCOML inputted thereto on the basis of the inputted scanning signal SFT_ST and alternating signal M and drives common lines COMn (n=1 to N where N is an integer).

The gate scanning circuit 13 produces gate voltages on the basis of the inputted scanning signal SFT_ST and drives gate lines Gn (n=1 to N where N is an integer).

A thin-film transistor 14 is connected to each of intersections of the gate lines Gn and the signal lines SIGn and the thin-film transistor 14 drives a display element 15. The gate lines Gn are scanned line by line and signal voltages for one line and common voltages for one line are applied to the display elements from the signal lines SIGn and the common lines COMn, respectively, so that the thin-film transistors 14 and the display elements 15 are driven line by line and this operation is repeated during one frame period to display a picture in accordance with the signal voltages.

Figure 17:
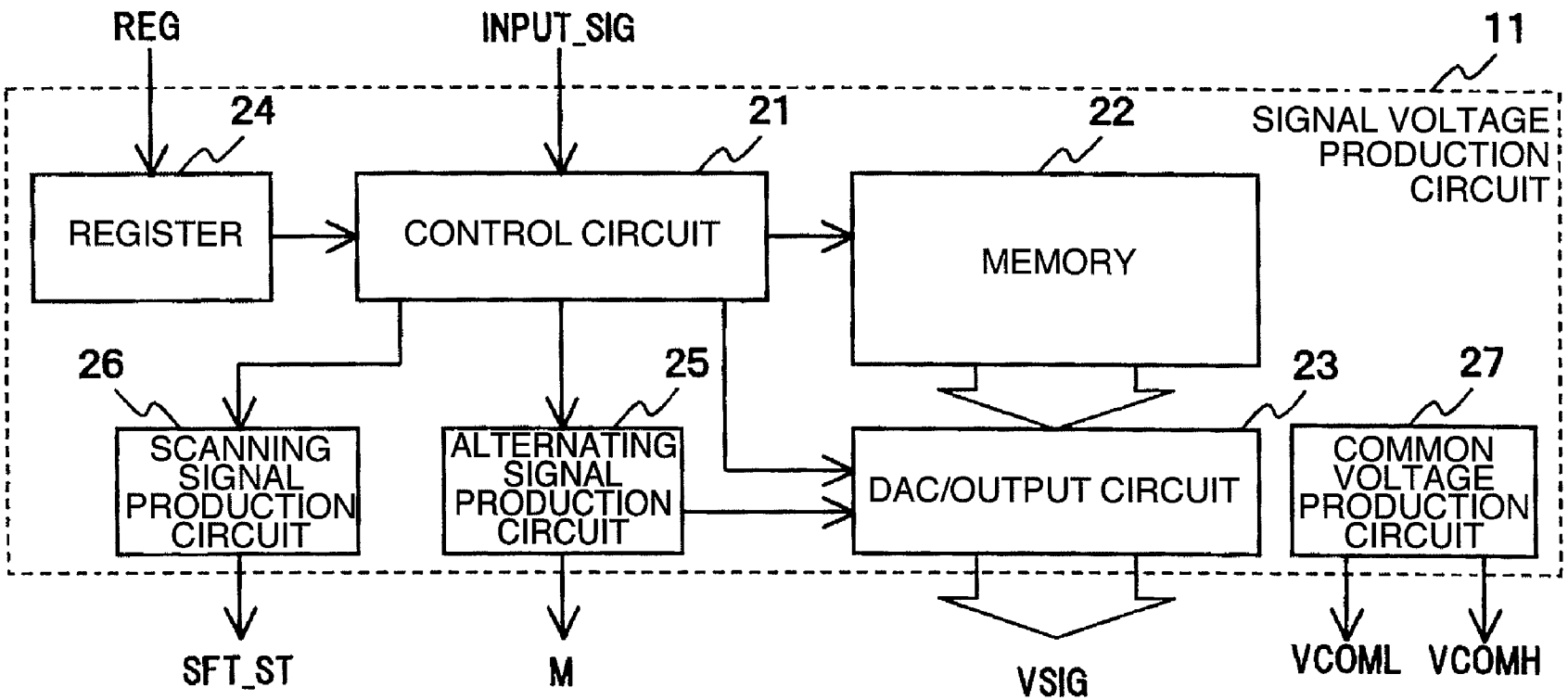
FIG. 17 is an internal block diagram illustrating a signal voltage production circuit 11 used in the embodiment shown in FIG. 16.

FIG. 17 is an internal block diagram illustrating the signal voltage production circuit 11 shown in FIG. 16. In FIG. 17, the input signal INPUT_SIG is stored in a memory 22 through a control circuit 21. The control circuit 21 controls the memory 22 and a DAC/output circuit 23 and makes the DAC/output circuit 23 convert data read out from the memory 22 into signal voltages VSIG. Moreover, the control signal REG is stored in a register 24 and read out by the control circuit 21 and the control circuit 21 makes an alternating signal production circuit 25 produce the alternating signal M. Further, the control circuit 21 makes a scanning signal production circuit 26 produce the scanning signals SFFT_ST on the basis of the synchronous signal contained in the input signal INPUT_SIG. The high-level common voltage VCOMH and the low-level common voltage VCOML are produced by a common voltage production circuit 27.

In the partial display, a partial display area in a display part and the alternating signal M (frame/line reversal) are controlled by setting stored in the register 24.

Figure 18:
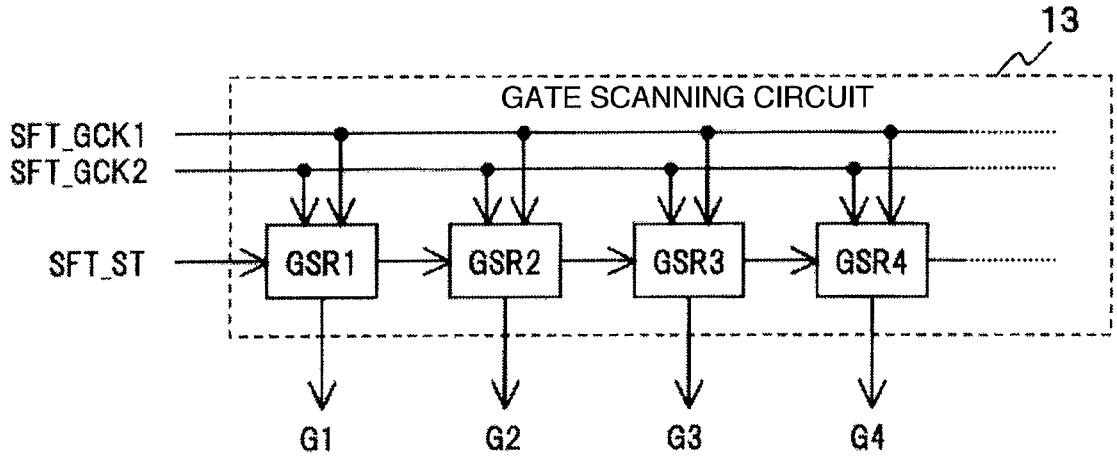
FIG. 18 is an internal block diagram illustrating a gate scanning circuit 13 used in the embodiment shown in FIG. 16.

FIG. 18 is an internal block diagram illustrating the gate scanning circuit 13 shown in FIG. 16. In FIG. 18, the scanning signal SFT_ST is inputted to a first gate shift register GSR 1 of gate shift registers GSRn (n=1 to N where N is an integer) and is successively transferred in response to gate clocks SFT_GCK1 and SFT_GCK2 having the reversed relation to each other, so that the gate voltages are outputted from the gate shift registers GSRn onto the gate lines Gn. The gate clocks SFT_GCK1 and SFT_GCK2 are supplied from the signal voltage production circuit.

Figure 19:
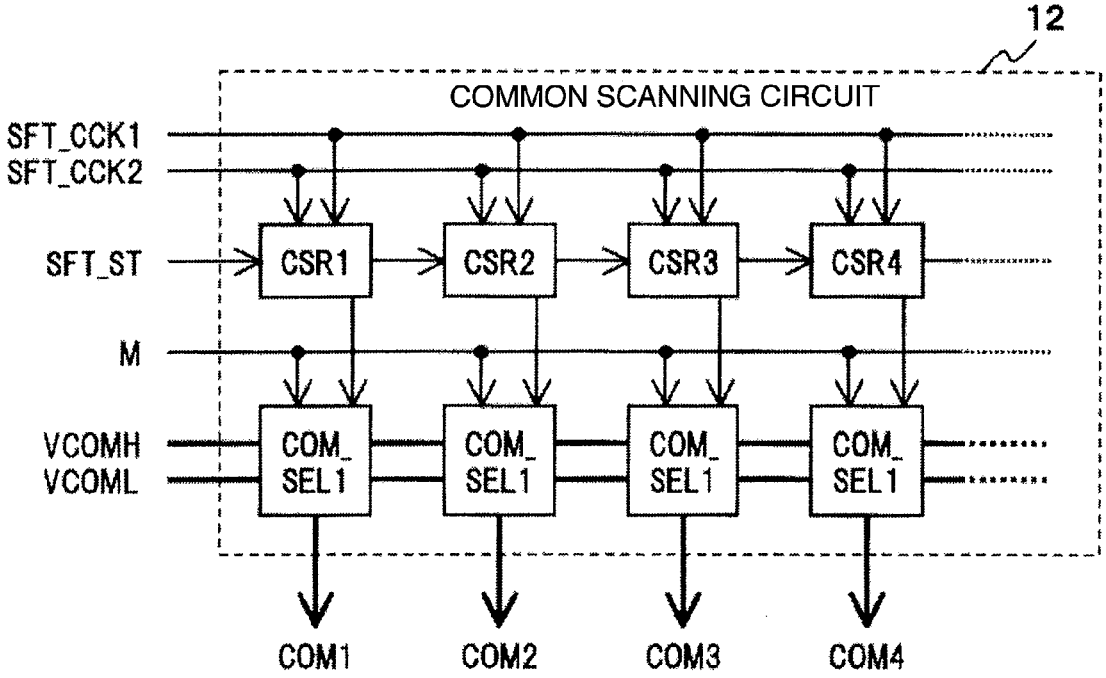
FIG. 19 is an internal block diagram illustrating a common scanning circuit 12 used in the embodiment shown in FIG. 16.

FIG. 19 is an internal block diagram illustrating the common scanning circuit 13 shown in FIG. 16. In FIG. 19, the scanning signal SFT_ST is inputted to a first common shift register CSR 1 of common shift registers CSRn (n=1 to N where N is an integer) and is successively transferred in response to common clocks SFT_CCK1 and SFT_CCK2 having the reversed relation to each other, so that common shift pulses are outputted from the common shift registers CSRn. The common clocks SFT_CCK1 and SFT_CCK2 are supplied from the signal voltage production circuit.

The common shift pulses from the common shift registers CSRn are inputted to common selectors COM_SELn (n=1 to N where N is an integer) and the common selectors COM_SELn select the high-level common voltage VCOMH when the alternating signal M is high level and select the low-level common voltage VCOML when the alternating signal M is low level in synchronism with the common shift pulses.

Figure 20C:
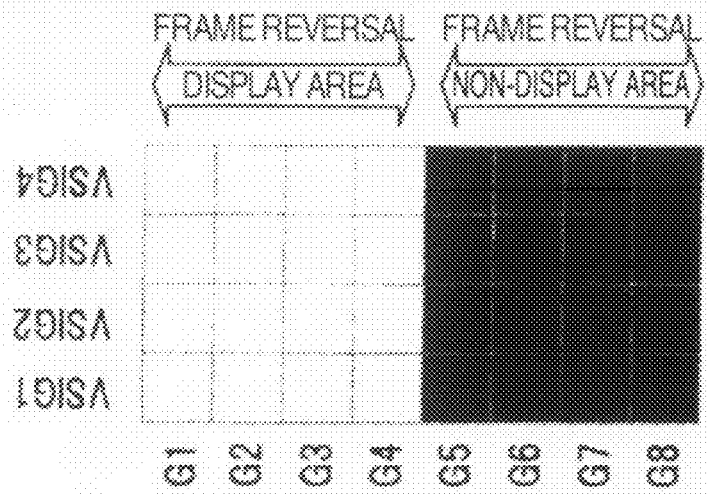
FIGS. 20A to 20C are diagrams showing display pictures in a display unit used in the embodiment shown in FIG. 16.
Figure 20B:
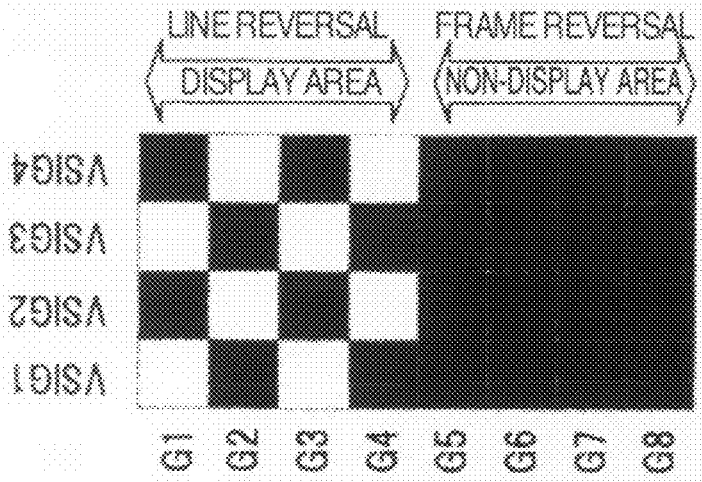
Figure 20A:
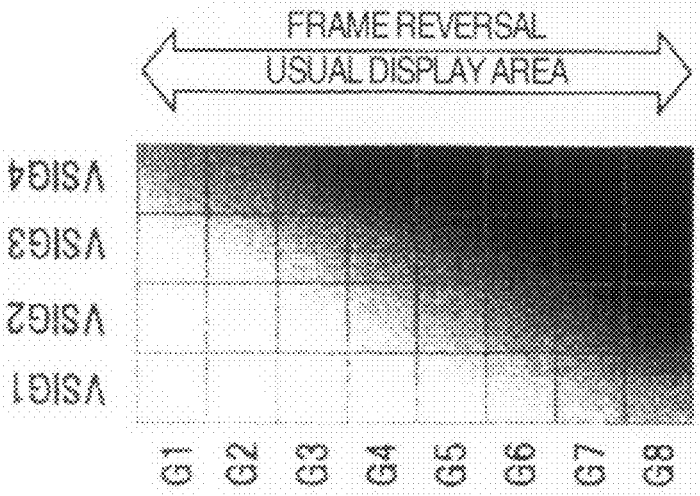

FIGS. 20A, 20B and 20C are diagrams showing display pictures in the display part. FIG. 20A shows a usual display picture which is displayed with multiple gradations in the display part, FIG. 20B shows a display picture having a checkered pattern dot-displayed in the partial display part and black displayed all over the non-display part, and FIG. 20C shows a display picture in which white is displayed all over the partial display part and black is displayed all over the non-display part. In this example, the display part is formed of 4×8 dots, the partial display part 4×4 dots, and the non-display part 4×4 dots, although the present invention is not limited thereto.

In FIG. 20A, the signal voltages VSIGn of multiple gradations are applied to the usual display area in a corresponding manner to the selected gate lines Gn and the common voltages are frame-reversed to make display having different gradations using dots. In FIG. 20B, a checkered pattern is displayed in a line-reversed manner in the display area and black is displayed over all in the frame-reversed manner in the non-display area. In FIG. 20C, white is displayed over all in the display area in the frame-reversed manner and black is displayed over all in the non-display area in the frame-reversed manner.

Figure 21:
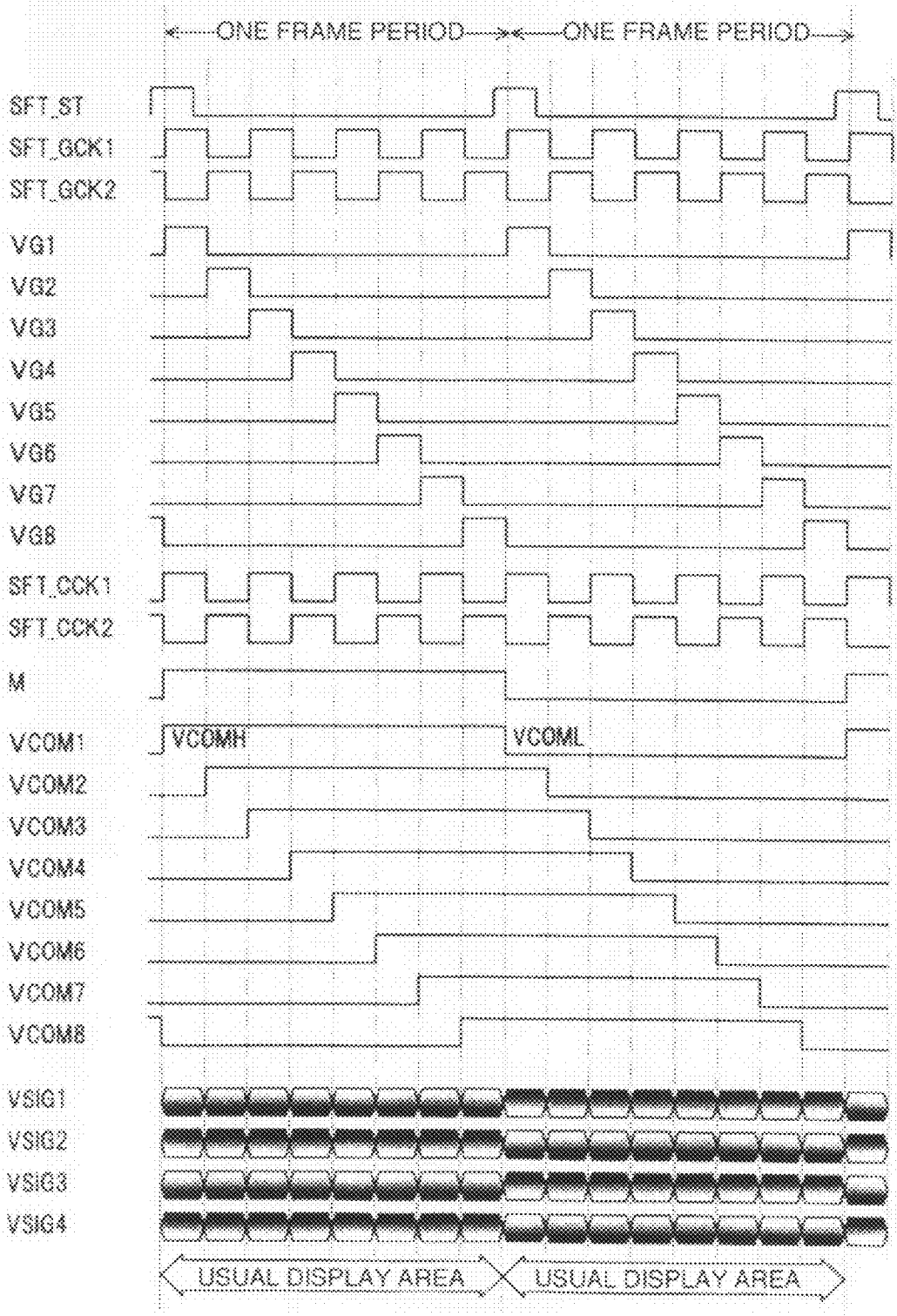
FIG. 21 is a timing chart showing operation in case where usual display shown in FIG. 20A is made.

FIG. 21 is a timing chart showing operation in case where the usual display shown in FIG. 20A is made. In FIG. 21, the scanning signal SFT_ST indicating one frame period is successively shifted in synchronism with the gate clocks SFT_GCK1 and SFT_GCK2 to produce the gate voltages VGn (n=1 to 8). Multi-gradation signal voltages VSIGn (n=1 to 4) for each line corresponding to the gate voltages VGn are successively displayed over one frame period.

In this case, the high-level common voltage VCOMH or the low-level common voltage VCOML is selected in synchronism with the common clocks SFT_CCK1 and SFT_CCK2 in accordance with a level of the alternating signal M to produce the common voltages VCOMn (n=1 to 8).

In FIG. 21, the common voltages VCOMn is frame-reversed voltages reversed every frame period and have the high-level common voltage VCOMH and the low-level common voltage VCOML repeated alternately. The common voltage VCOMn is high level in first one frame period and is low level in next one frame period.

Figure 22:
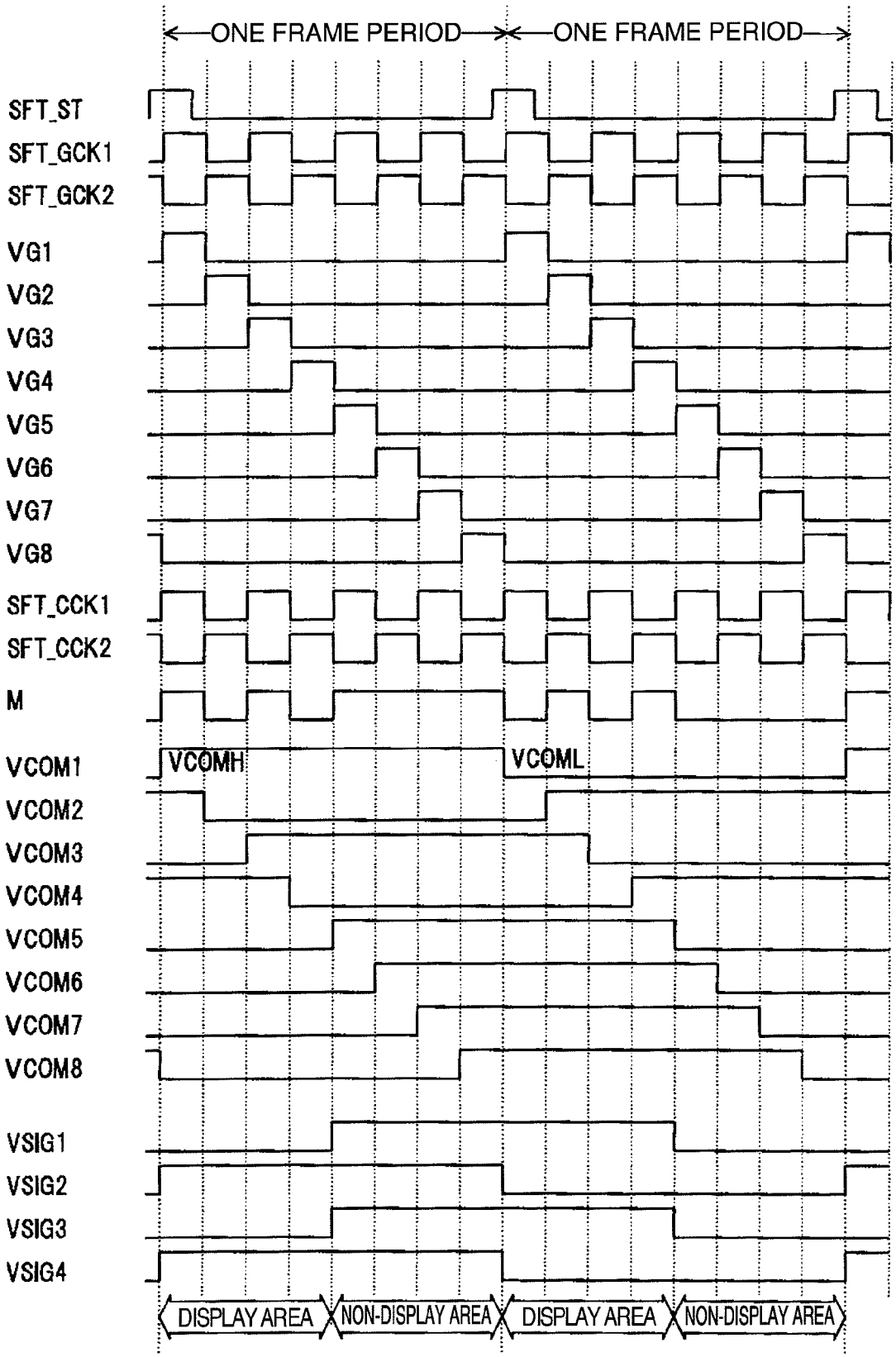
FIG. 22 is a timing chart showing operation in case where a checkered pattern shown in FIG. 20B is partially displayed.

FIG. 22 is a timing chart showing operation in case where the checkered display pattern shown in FIG. 20B is partially displayed. FIG. 22 is different from FIG. 21 in that the alternating signal M is reversed every line in the partial display area (4×4 dots) in the first half of one frame period. Therefore, the common voltages VCOM1 to VCOM4 are line-reversed every line. Accordingly, the signal voltages VSIG1 to VSIG4 are set to be low level, high level, low level and high level in the scanning period of 4 lines, so that the checkered display pattern can be displayed. In next frame period, the alternating signal M is reversed and accordingly the signal voltages VSIG1 to VSIG4 are also reversed to be high level, low level, high level and low level.

In other words, since the common voltages are line-reversed every line, the signal voltages can be made to be high level or low level over four lines without making the signal voltages to be high level or low level every line. Since this means that the frequency component of the signal voltages is made low, the driving power in the signal voltage production circuit which drives the signal lines by the signal voltages having the low frequency component can be reduced, so that the power consumption in the display device can be reduced.

In the non-display area in the second half of one frame period (all black display of 4×4 dots), since the common voltages VCOM5 to VCOM8 are frame-reversed to be high level, the signal voltages VSIG1 to VSIG4 are set to be high level so that black is displayed. In next frame period, since the common voltages VCOM5 to VCOM8 are frame-reversed to be low level, the signal voltages VSIG1 to VSIG4 are set to be low level so that black is displayed.

As shown in FIG. 17, the alternating signal V is set by the control circuit 21 on the basis of the control signal stored in the register 24 and the control circuit 21 reduces the frequency component of the signal voltages VSIG in accordance with the display pattern.

Figure 23:
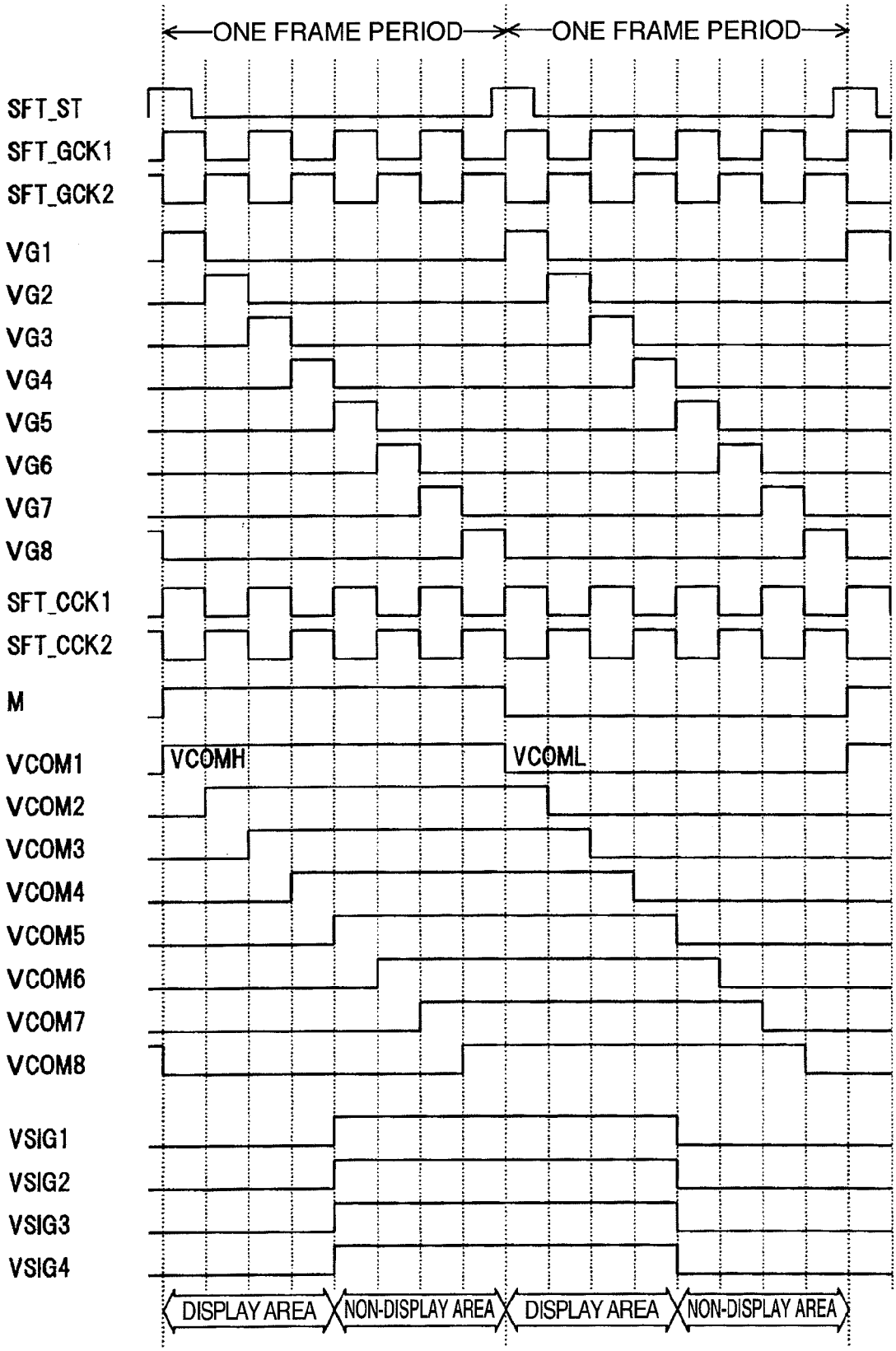
FIG. 23 is a timing chart showing operation in case where a display pattern of all white shown in FIG. 20C is partially displayed.

FIG. 23 is a timing chart showing operation in case where the display pattern of all white shown in FIG. 20C is partially displayed. FIG. 23 is different from FIG. 22 in that the partial display area is frame-reversed without making line reversal. Accordingly, in first frame period that the common voltages VCOMn are high level, the signal voltages VSIGn are made to be low level in the partial display area and the signal voltages VSIGn are made to be high level in the non-display area where black is displayed over all. In next frame period, these voltages are reversed.

As described above, in case where white is partially displayed over all, the signal voltages VSIGn must be also reversed every line when line is reversed as shown in FIG. 22 and the frequency component of the signal voltages VSIGn are high. Accordingly, the frame is reversed without reversing the line.

Embodiment 4

Figure 24:
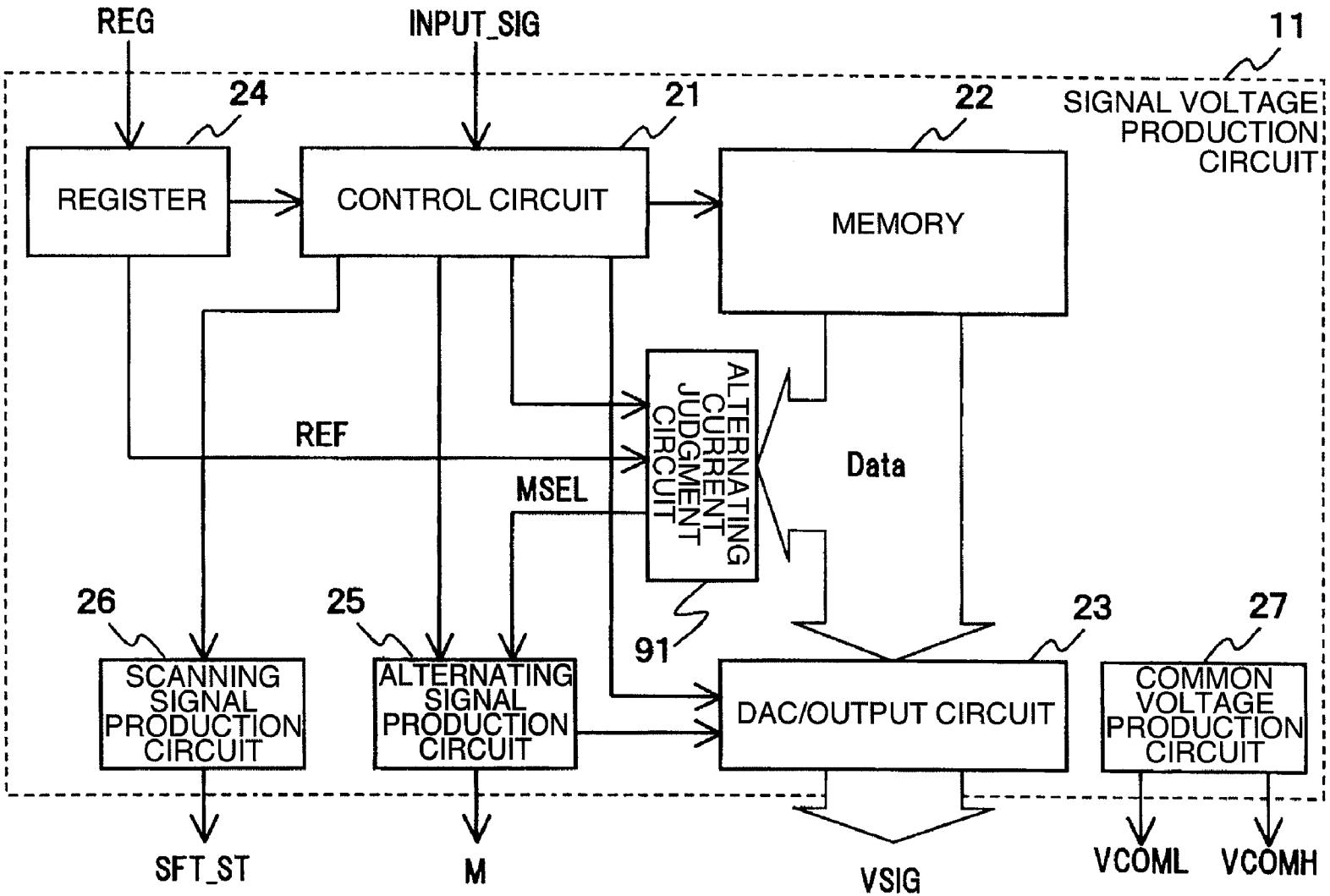
FIG. 24 is another block diagram illustrating the signal voltage generation circuit 11 used in the embodiment shown in FIG. 16.

FIG. 24 is another block diagram illustrating the signal voltage production circuit 11 shown in FIG. 16. The signal voltage production circuit 11 shown in FIG. 24 includes an alternating current judgment circuit 91 in addition to the signal voltage production circuit 11 shown in FIG. 17. The alternating current judgment circuit 91 is controlled by the control circuit 21 and compares data (Data) for two lines transferred from the memory 22 to supply to the alternating signal production circuit 25 a judgment signal MSEL for judging whether the common voltages are line-reversed or not on the basis of a reference value REF set in the register 24. The alternating signal production circuit 25 reverses the alternating signal M indicated by the control circuit 21 on the basis of the judgment signal MSEL.

FIG. 25 is a block diagram illustrating the alternating current judgment circuit 91 shown in FIG. 24. In FIG. 24, data for one line transferred from the memory 22 is stored in a data memory circuit 101 and this data (DataR) before one line is compared with current data (Data) for one line by a data comparison circuit 102. The data comparison circuit 102 is constituted by EOR circuit, for example, and the data comparison circuit 102 outputs 0 when data before one line is equal to current data for one line and outputs 1 when not equal. The data comparison circuit 102 compares the sum of data values outputted for one line with the reference value REF. As a result of the comparison, when the sum is larger than or equal to the reference value REF, the common voltages are line-reversed in order to suppress charge and discharge power in the signal lines and when the sum is smaller than the reference value REF, the common voltages are not line-reversed.

FIG. 26 is a diagram showing a picture displayed in the display part for explaining the above operation. In FIG. 26, the display part is formed of 4×8 dots, the partial display part 4×4 dots and the non-display part 4×4 dots, although the present invention is not limited thereto.

FIG. 27 is a table showing the judgment signal MSEL in case where the number of data in the horizontal direction is 4 as shown in FIG. 26, the reference value REF is 2 and the sum of data for one line is Sum. When the judgment signal MSEL is 0, the common voltages are not line-reversed and when the judgment signal MSEL is 1, the common voltages are line-reversed.

Figure 28:
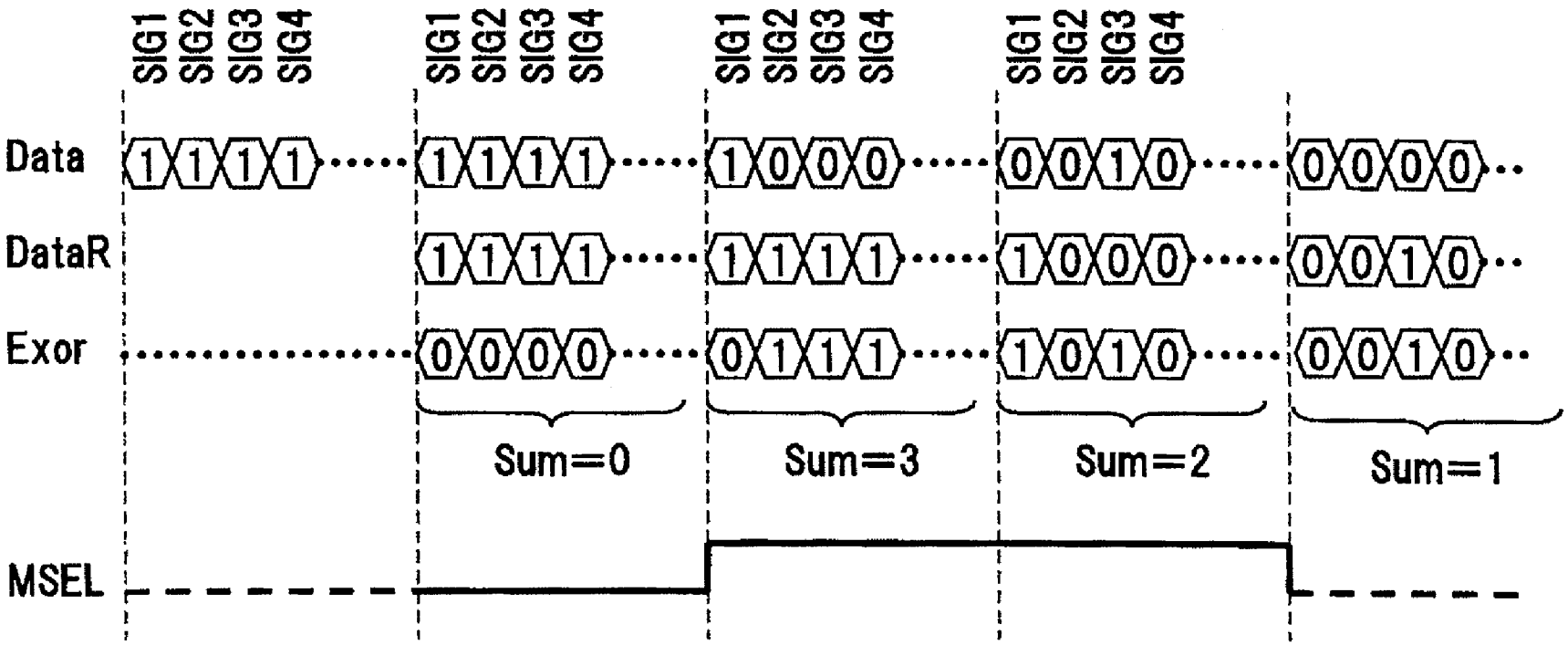
FIG. 28 is a timing chart showing operation of the alternating current judgment circuit 91 shown in FIG. 25.

FIG. 28 is a timing chart showing operation of the alternating current judgment circuit 91 in case of the display pattern shown in FIG. 26. In FIG. 28, current data (Data) and data (DataR) before one line are subjected to exclusive-OR operation (Exor) from the second line and its result is defined as the sum (Sum). When the sum (Sum) is larger than or equal to 2, the judgment signal MSEL is set to be high level and when the sum (Sum) is smaller than 2, the judgment signal MSEL is set to be low level.

In other words, when the correlation between current data for one line and data before one line is low (Sum is larger than or equal to 2), the common voltages are line-reversed and when the correlation is high (Sum is smaller than 2), the common voltages are not line-reversed and frame reversal is left as it is. Consequently, the frequency component of the signal voltages can be reduced.

Since the first line is controlled by reversal of the alternating current to the display element (liquid crystal) itself, the first line does not depend on the judgment signal MSEL. That is, the alternating current is reversed in synchronism with the synchronous signal in the input signal supplied externally. Accordingly, since the judgment signal MSEL exerts influence on two to four lines as shown in FIG. 28, other lines may be high level or low level.

Figure 29:
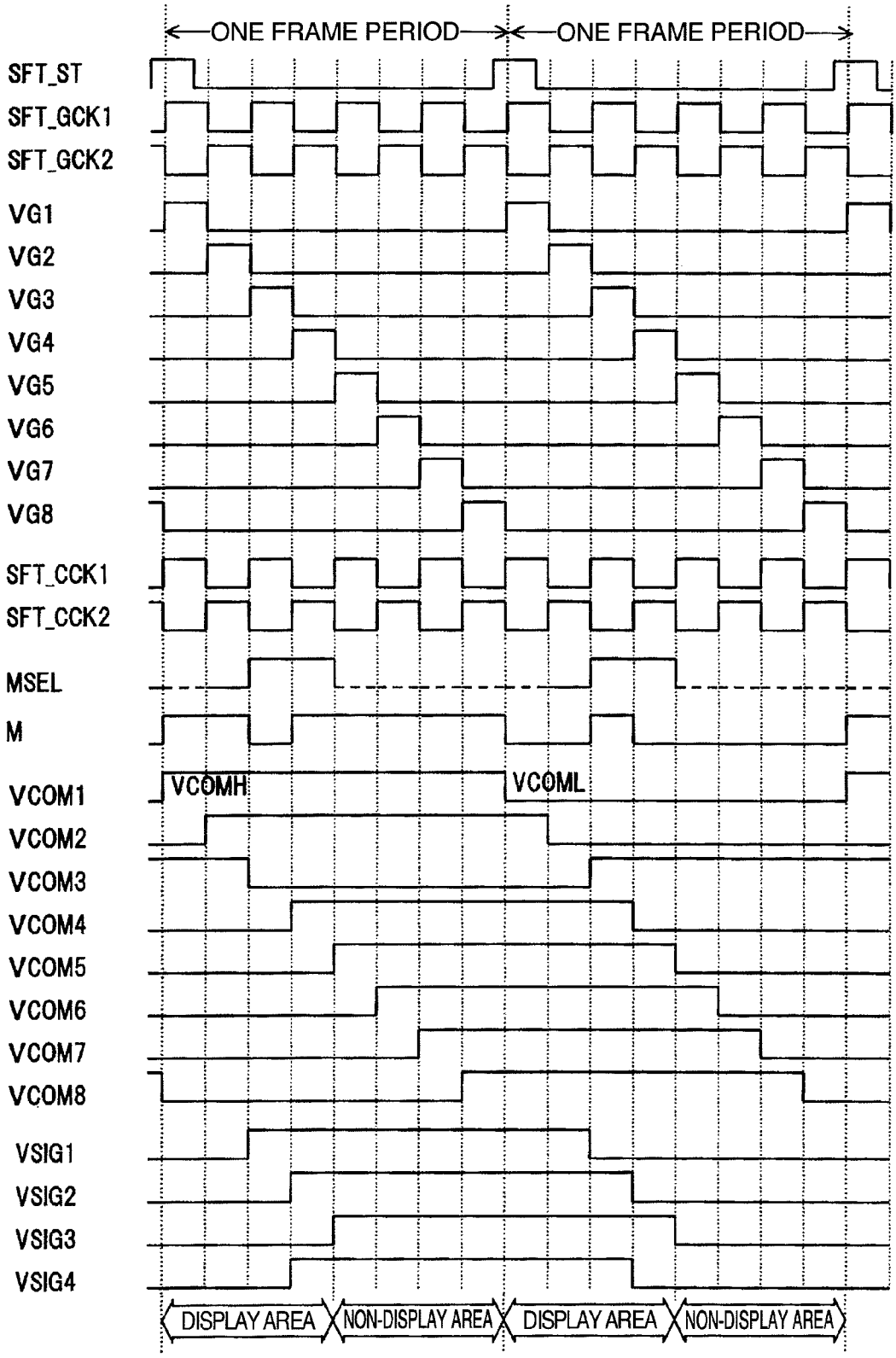
FIG. 29 is a timing chart showing operation in case where the display pattern shown in FIG. 26 is displayed.

FIG. 29 is a timing chart showing the above operation. This operation is different from that of the timing charts described so far in that the judgment signal MSEL is used to reverse the alternating signal M. In FIG. 29, the common voltage VCOM3 of the third line is line-reversed to thereby reduce the frequency component of the signal voltage VSIGn.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device having first and second display modes, wherein a display panel is scanned every n (n is an integer larger than or equal to 1) lines during the whole period of one frame period in the first display mode, and the display panel is scanned every m (m is an integer larger than n) lines during partial period in the one frame period in the second display mode, a current flowing through a driving circuit for driving the display panel being reduced during other period in the one frame period.

2. A display device according to claim 1, wherein the driving circuit includes an output circuit to supply gradation signals to the display panel and a current flowing through the output circuit is reduced as the current flowing through the driving circuit.

3. A display device according to claim 1, wherein the driving circuit includes an amplifier to buffer the gradation signals supplied to the display panel and a stead-state current of the amplifier is reduced as the current flowing through the driving circuit.

4. A display device according to claim 3, wherein the driving circuit includes a conversion circuit to convert display data into the gradation signals and the amplifier buffers the gradation signals converted by the conversion circuit.

5. A display device according to claim 1, wherein when the current flowing through the driving circuit in the first display mode is Inml, the current flowing through the driving circuit during partial period in the one frame period in the second display mode is Ips and the current flowing through the driving circuit during other period in the one frame period in the second display mode is Islp, the following relation is satisfied:

$$Inml > Ips > Islp.$$

6. A display device according to claim 1, wherein the number of display gradations in the second display mode is smaller than that in the first display mode.

7. A display device according to claim 6, wherein the number of display gradations in the first display mode is equal to the number of all gradations and the number of display gradations in the second display mode is equal to two in each color of red, green and blue.

8. A display device according to claim 1, wherein a display area of the display panel in the second display mode is smaller than that in the first display mode.

9. A display device according to claim 8, wherein the display area of the display panel in the first display mode is the whole display area of the display panel and the display area of the display panel in the second display mode is partial display area of the display panel.

10. A display device according to claim 8, wherein the partial display area of the display panel is scanned every m lines in the second display mode and other display area of the display panel is scanned every l (l is an integer larger than m) lines in the second display mode.

11. A display device according to claim 1, wherein the n is 1 and the m is 2, the partial period in the one frame period being a scanning period in which gradation signals in a display area in the one frame period are rewritten, the other period in the one frame period being a scanning period in which the gradation signals except the display area in the one frame period are rewritten.

* * * * *